US010303078B2

(12) United States Patent
Anno et al.

(10) Patent No.: US 10,303,078 B2
(45) Date of Patent: May 28, 2019

(54) IMAGE FORMING APPARATUS HAVING TWO TRANSFER UNITS

(71) Applicant: FUJI XEROX CO., LTD., Tokyo (JP)

(72) Inventors: Shintaro Anno, Kanagawa (JP); Yasuaki Hashimoto, Kanagawa (JP); Takuro Watanabe, Kanagawa (JP); Hiroaki Saijo, Kanagawa (JP); Fusako Kiyono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/960,565

(22) Filed: Apr. 24, 2018

(65) Prior Publication Data

US 2019/0094739 A1 Mar. 28, 2019

(30) Foreign Application Priority Data

Sep. 27, 2017 (JP) ..... 2017-185985

(51) Int. Cl.

| | |
|---|---|
| ***G03G 15/01*** | (2006.01) |
| ***G03G 9/08*** | (2006.01) |
| ***G03G 9/107*** | (2006.01) |
| ***G03G 9/113*** | (2006.01) |

(Continued)

(52) U.S. Cl.

CPC ..... *G03G 15/0189* (2013.01); *G03G 9/0819* (2013.01); *G03G 9/0823* (2013.01); *G03G 9/08711* (2013.01); *G03G 9/08755* (2013.01); *G03G 9/1075* (2013.01); *G03G 9/1133* (2013.01); *G03G 9/091* (2013.01); *G03G 9/0902* (2013.01); *G03G 9/092* (2013.01);

(Continued)

(58) Field of Classification Search

CPC . G03G 15/0189; G03G 9/0819; G03G 9/0823

See application file for complete search history.

(56) References Cited

U.S. PATENT DOCUMENTS 5,659,860 A * 8/1997 Sasaki ..... G03G 9/08 399/267
9,158,226 B1 * 10/2015 Anno ..... G03G 21/1803
2006/0018465 A1 1/2006 Saeki et al.

(Continued)

FOREIGN PATENT DOCUMENTS

EP 1633015 3/2006
JP H03126045 5/1991

(Continued)

*Primary Examiner* — G. M. A Hyder
(74) *Attorney, Agent, or Firm* — JCIPRNET

(57) ABSTRACT

An image forming apparatus includes: a first image forming unit that includes a first image holding member and a first developing unit, the first developing unit accommodating a first developer that includes a first toner and a first carrier; a first transfer unit; a second image forming unit that is disposed downstream of the first image forming unit in a traveling direction of a transfer medium and includes a second image holding member and a second developing unit, the second developing unit accommodating a second developer that includes a second toner and a second carrier; and a second transfer unit, in which a volume resistivity of the first carrier is higher than a volume resistivity of the second carrier, and a volume average particle diameter of the first carrier is more than a volume average particle diameter of the second carrier.

15 Claims, 2 Drawing Sheets

(51) Int. Cl.
*G03G 9/087* (2006.01)
*G03G 9/09* (2006.01)

(52) U.S. Cl.
CPC ..... *G03G 9/0904* (2013.01); *G03G 9/0918* (2013.01); *G03G 2215/1623* (2013.01)

(56) References Cited

U.S. PATENT DOCUMENTS

2007/0218394 A1 9/2007 Mizobe et al.
2017/0285518 A1* 10/2017 Hara ..... G03G 15/0865

FOREIGN PATENT DOCUMENTS

JP 2006041570 2/2006
JP 2006074349 3/2006
JP 2007219321 8/2007
JP 2007248971 9/2007

* cited by examiner

IMAGE FORMING APPARATUS HAVING TWO TRANSFER UNITS

CROSS-REFERENCE TO RELATED APPLICATIONS

This application is based on and claims priority under 35 USC 119 from Japanese Patent Application No. 2017-185985 Sep. 27, 2017.

BACKGROUND

(i) Technical Field

The present invention relates to an image forming apparatus and a developer set.

(ii) Related Art

In electrophotography, an electrostatic charge image formed on a surface of an image holding member (photoreceptor) is developed using a developer including toner to form a toner image, and the obtained toner image is transferred to a recording medium and fixed with a heating roller or the like, thereby obtaining an image.

SUMMARY

According to an aspect of the invention, there is provided an image forming apparatus including: a first image forming unit that includes a first image holding member and a first developing unit, the first developing unit accommodating a first developer that includes a first toner and a first carrier and developing an electrostatic charge image formed on a surface of the first image holding member using the first developer to form a first toner image on the surface of the first image holding member; a first transfer unit that transfers the first toner image formed on the surface of the first image holding member to a transfer medium; a second image forming unit that is disposed downstream of the first image forming unit in a traveling direction of the transfer medium and includes a second image holding member and a second developing unit, the second developing unit accommodating a second developer that includes a second toner and a second carrier and developing an electrostatic charge image formed on a surface of the second image holding member using the second developer to form a second toner image on the surface of the second image holding member; and a second transfer unit that transfers the second toner image formed on the surface of the second image holding member to the transfer medium to which the first toner image is transferred, in which a volume resistivity of the first carrier is higher than a volume resistivity of the second carrier, and a volume average particle diameter of the first carrier is more than a volume average particle diameter of the second carrier.

BRIEF DESCRIPTION OF THE DRAWINGS

Exemplary embodiment(s) of the present invention will be described in detail based on the following figures, wherein.

DETAILED DESCRIPTION

Figure 1:
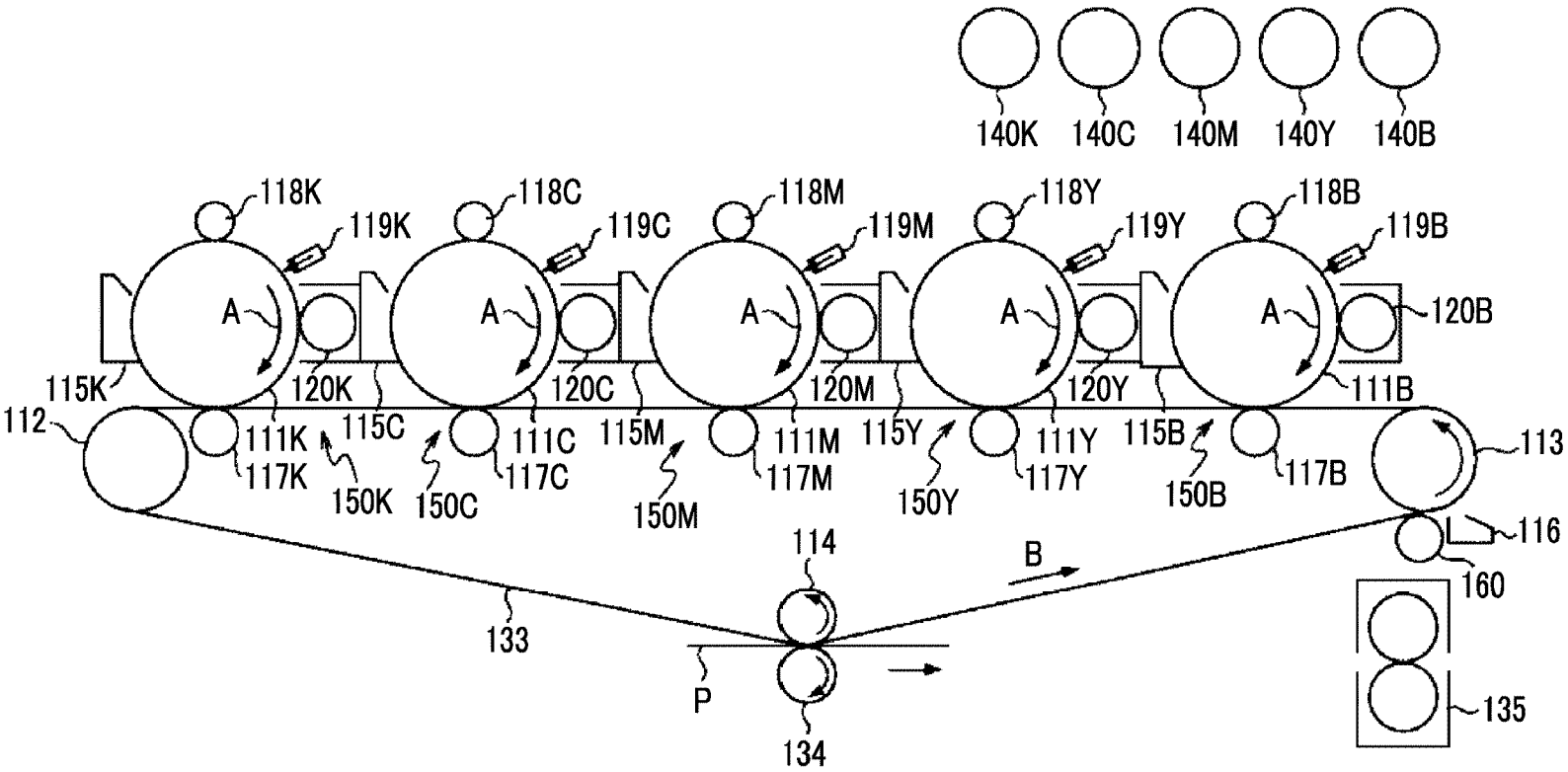
FIG. 1 is a diagram schematically showing a configuration example of an image forming apparatus according to an exemplary embodiment of the invention.

Hereinafter, an exemplary embodiment which is an example of the invention will be described in detail.

Image Forming Apparatus and Image Forming Method

An image forming apparatus and an image forming method according to the exemplary embodiment will be described.

An image forming apparatus according to the exemplary embodiment includes: a first image forming unit; and a second image forming unit that is disposed downstream of the first image forming unit in a traveling direction of a transfer medium.

Hereinafter, the image forming unit will also be simply referred to as "unit". In addition, the downstream side in the traveling direction of the transfer medium will also be referred to as "downstream side", and the upstream side in the traveling direction of the transfer medium will also be referred to as "upstream side".

The first unit includes: a first image holding member; and a first developing unit that develops an electrostatic charge image formed on a surface of the first image holding member using a first developer to form a toner image on the surface of the first image holding member. In addition, the second unit includes: a second image holding member; and a second developing unit that develops an electrostatic charge image formed on a surface of the second image holding member using a second developer to form a toner image on the surface of the second image holding member.

The first developing unit accommodates the first developer that includes a first toner and a first carrier, and the second developing unit accommodates the second developer that includes a second toner and a second carrier.

In addition, the image forming apparatus according to the exemplary embodiment includes: a first transfer unit that transfers the toner image, which is formed on the surface of the first image holding member by the first developing unit, to the transfer medium; and a second transfer unit that transfers the toner image, which is formed on the surface of the second image holding member by the second developing unit, to the transfer medium to which the first toner image is transferred.

In the image forming apparatus according to the exemplary embodiment, a volume resistivity of the first carrier is higher than a volume resistivity of the second carrier, and a volume average particle diameter of the first carrier is more than a volume average particle diameter of the second carrier.

In addition, the image forming method according to the exemplary embodiment includes: a first image forming step of forming a first electrostatic charge image on a surface of the first image holding member, developing the first electrostatic charge image using the first developer including the first toner and the first carrier to form a first toner image on the surface of the first image holding member, and transferring the first toner image to the transfer medium in the first unit; and a second image forming step of forming a second electrostatic charge image on a surface of the second image holding member, developing the second electrostatic charge image using the second developer including the second toner and the second carrier to form a second toner image on the surface of the second image holding member, and transferring the second toner image to the transfer medium to which the first toner image is transferred in the second unit.

In the image forming method according to the exemplary embodiment, a volume resistivity of the first carrier is higher than a volume resistivity of the second carrier, and a volume average particle diameter of the first carrier is more than a volume average particle diameter of the second carrier.

Here, "image forming unit" is an image forming unit including at least an image holding member and a developing unit, and the image forming unit may further include at least one selected from the group consisting of a charging unit, an electrostatic charge image forming unit, and a cleaning member that cleans an image holding member.

"Transfer medium" described herein refers to a medium to which a toner image formed on a surface of an image holding member is transferred. For example, the transfer medium is a recording medium in a direct transfer type apparatus in which a toner image formed on a surface of an image holding member is directly transferred to a recording medium. In addition, the transfer medium is an intermediate transfer member in an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium.

In addition, the second unit that is "disposed downstream of the first image forming unit in the traveling direction of the transfer medium" is a unit that is disposed downstream of the first unit among plural units that are disposed along the traveling direction of the transfer medium.

In a case where the second unit is disposed downstream of the first unit, one second unit or plural second units may be provided. In the image forming apparatus including plural second units, the first carrier has a higher volume resistivity than the second carrier accommodated in each of the plural second units and has a larger volume average particle diameter than the second carrier. In addition, the image forming apparatus including plural second units includes the same number of second transfer units as that of the second units.

In addition, the image forming apparatus may further include units other than the first unit and the second unit (for example, a unit that is disposed upstream of the first unit).

In the image forming apparatus according to the exemplary embodiment, the volume resistivity of the first carrier accommodated in the first unit is higher than that of the second carrier accommodated in the second unit, and the volume average particle diameter of the first carrier is more than that of the second carrier. Therefore, formation of a white line which may occur on an image formed after continuous formation of low-density images is suppressed, as compared to a case where the volume resistivity of the first carrier is higher than that of the second carrier and the volume average particle diameter of the first carrier is the same as that of the second carrier.

The reason is not clear but is presumed to be as follows.

Recently, a demand not only for formation of an image using toners of the related art including a yellow toner, a magenta toner, a cyan toner, and a black toner but also for formation of an image using special color toners such as a brilliant toner, a white toner, and a transparent toner has increased.

A carrier used in combination with the special color toners is designed according to characteristics or use of the toners. Therefore, a carrier having different characteristics (for example volume resistivity) from a carrier used in combination with the toners of the related art may be used.

Specifically, for example, a brilliant toner including a flaky brilliant pigment or a white toner including a white pigment includes a conductive pigment. Therefore, the volume resistivity is likely to be lower than that of the toners of the related art. Thus, as a carrier used in combination with the brilliant toner or the white toner, a carrier having a higher volume resistivity than the carrier of the related art is used.

In addition, for example, a transparent toner (that is, a toner including no colorants or 1.0% by mass or lower of a colorant with respect to the amount of toner particles) is used for forming a thick toner image in many cases. Therefore, the transparent toner is used in combination with a carrier having a higher volume resistivity than the carrier of the related art.

Therefore, for example, in the image forming apparatus in which a developer including the special color toner and a developer including the toner of the related art are accommodated in developing units of respective units, the volume resistivities of the carriers accommodated in the units are different from each other.

In addition, not only in the special color toners but also in the toners of the related art including a yellow toner, a magenta toner, a cyan toner, and a black toner, carriers having different volume resistivities may be used in a case where, for example, characteristics or uses of the toners are different.

That is, in the image forming apparatus including plural image forming units, for example, the first unit accommodates the first developer including the first carrier having a relatively high volume resistivity, and the second unit accommodates the second developer including the second carrier having a relatively low volume resistivity. In a case where the first unit and the second unit are disposed along the traveling direction of the transfer medium, for example, the first toner image formed by the first unit is transferred to the transfer medium, and then the second toner image formed by the second unit is transferred to the transfer medium.

At this time, in a case where the first carrier (that is, the carrier having a relatively high volume resistivity) accommodated in the first unit is incorporated into the first toner image, the first carrier may be incorporated into the second unit through the first toner image of the transfer medium.

Specifically, first, in a case where the first carrier is incorporated into the first toner image formed on the first image holding member of the first unit, the first toner image including the first carrier is transferred from the first image holding member to the transfer medium by the first transfer unit. In a case where the second toner image formed on the second image holding member is transferred to the transfer medium by the second transfer unit, the first carrier included in the first toner image formed on the transfer medium may be transferred to the second image holding member and incorporated into the second developer accommodated in the second developing unit.

In a case where the second unit includes a cleaning member that cleans the second image holding member, a part of the first carrier transferred to the second image holding member is removed by the cleaning member. However, the other part of the first carrier may pass through the cleaning member without being completely removed, may reach the second developing unit, and may be incorporated into the second developer. In particular, in a case where the cleaning member is a blade cleaning type cleaning member including a cleaning blade, the first carrier is likely to pass through the cleaning blade during image formation after continuous formation of low-density images in a low-temperature and low-humidity environment (in particular, in a non-image forming portion).

In the second developing unit in which the first carrier having a relatively high volume resistivity is incorporated into the second developer, a brush (that is, magnetic brush) including both the first carrier having a high resistance and the second carrier having a low resistance is formed.

At this time, after the toner attached to the first carrier having a high resistance is removed in a developing step, charges having a polarity opposite to that of the toner are likely to remain on a surface of the first carrier. In a case where the first carrier in which the charges having a polarity opposite to that of the toner remain on the surface is present at a tip of the magnetic brush, due to an electrostatic force of the charges included in the first carrier, the second toner may be removed from the second toner image that is formed on the second image holding member in the developing step. A portion where the second toner is removed causes "a decrease in density" or "formation of a white line" to occur on a finally obtained image. In particular, in a case where a halftone image is formed (in particular, in a case where a halftone image is formed after formation of a solid image), the formation of a white line is likely to be significant.

On the other hand, in the exemplary embodiment, the volume average particle diameter of the first carrier having a high resistance is more than that of the second carrier. Therefore, in a case where the first carrier having large particle diameter is disposed at the tip of the magnetic brush, the magnetic brush becomes unstable and folded such that the carriers are likely to be disposed again. As a result, the first carrier having a high resistance is likely to be disposed on the base side (for example, developer holding member side) of the magnetic brush, and is not likely to be present at the tip end of the magnetic brush. As a result, "formation of a white line" is suppressed.

This way, it is presumed that formation of a white line, which may occur on an image formed after continuous formation of low-density images, is suppressed.

As the image forming apparatus according to the exemplary embodiment, various well-known image forming apparatuses may be used, the apparatuses including: a direct transfer type apparatus in which a toner image formed on a surface of an image holding member is directly transferred to a recording medium; an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium; an apparatus including a cleaning unit that cleans a surface of an image holding member after a toner image is transferred and before charging; and an apparatus including an erasing unit that irradiates a surface of an image holding member with erasing light for erasing charges after a toner image is transferred and before charging.

In the intermediate transfer type apparatus, for example, a transfer unit includes: an intermediate transfer member having a surface to which a toner image is transferred; a primary transfer unit that primarily transfers a toner image, which is formed on a surface of an image holding member, to the surface of the intermediate transfer member; and a secondary transfer unit that secondarily transfers the toner image, which is transferred to the surface of the intermediate transfer member, to a surface of a recording medium. In this case, as the primary transfer unit, the first transfer unit and the second transfer unit are used.

In the image forming apparatus according to the exemplary embodiment, for example, a portion of each of the units including the developing unit may have a cartridge structure (process cartridge) which is detachable from the image forming apparatus.

Hereinafter, the image forming apparatus according to the exemplary embodiment will be described using, as an example, an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium. However, the image forming apparatus is not limited to the intermediate transfer type apparatus. Major components shown in the drawings will be described, and the other components will not be described.

FIG. 1 is a diagram schematically showing a configuration of an example of the image forming apparatus according to the exemplary embodiment of the invention.

The image forming apparatus shown in FIG. 1 is an intermediate transfer type image forming apparatus that has a tandem type configuration including plural image forming units, in which a brilliant toner is used as the special color toner, and an intermediate transfer belt is provided as an intermediate transfer member which is a transfer medium.

In the image forming apparatus shown in FIG. 1, an image forming unit 150B and four image forming units 150Y, 150M, 150C, and 150K are disposed in parallel (in tandem), the image forming unit 150B forming a metallic toner image having brilliance using a developer including a brilliant toner, and the image forming units 150Y, 150M, 150C, and 150K forming toner images of colors including yellow, magenta, cyan, and black.

The image forming units 150Y, 150M, 150C, 150K, and 150B are disposed in this order from the downstream side in a rotating direction of an intermediate transfer belt 133.

Here, in the image forming apparatus shown in FIG. 1, the image forming unit 150B corresponds to the first unit. A developing device 120B (that is, the first developing unit) of the unit 150B accommodates the first developer that includes a brilliant toner corresponding to the first toner and includes the first carrier having a relatively high volume resistivity and having a relatively large volume average particle diameter.

In addition, the units 150Y, 150M, 150C, and 150K correspond to the second unit. Developing device 120Y, 120M, 120C, and 120K (that is, the second developing unit) of the units 150Y, 150M, 150C, and 150K accommodate second developers that include a yellow toner, a magenta toner, a cyan toner, and a black toner, respectively, and include the second carrier having a relatively low volume resistivity and having a relatively small volume average particle diameter. In this case, the yellow toner, the magenta toner, the cyan toner, and the black toner correspond to the second toner.

As the first developer and the second developer, a first developer and a second developer constituting a developer set described below are used, respectively. The details of the first developer and the second developer will be described below.

Here, the image forming units 150B, 150Y, 150M, 150C, and 150K have the same configuration, except for the colors of the toners in the developers accommodated therein. Therefore, here, the image forming unit 150B that forms a metallic image will be described as a representative example.

In addition, a photoreceptor 111B that is included in the unit 150B corresponds to the first image holding member, a toner image that is formed by the unit 150B corresponds to the first toner image, and a primary transfer roller 117B that transfers the first toner image to the intermediate transfer belt 133 corresponds to the first transfer unit. In addition, photoreceptors 111Y, 111M, 111C, and 111K that are included in the units 150Y, 150M, 150C, and 150K, respectively, correspond to the second image holding member, toner images that are formed by the units 150Y, 150M, 150C, and 150K, respectively, correspond to the second toner image, and primary transfer rollers 117Y, 117M, 117C, and 117K that transfer the second toner images to the intermediate transfer belt 133, respectively, correspond to the second transfer unit.

The same components as those of the unit 150K are represented by reference numerals to which the symbols Y (yellow), M (magenta), C (cyan), and K (black) are attached instead of the symbol B (metallic), and the units 150Y, 150M, 150C, and 150K will not be described.

The metallic unit 150B includes the photoreceptor 111B (that is, the first image holding member) as an image holding member. The photoreceptor 111B is rotated by a driving unit (not shown) at a predetermined process speed in a direction indicated by arrow A in FIG. 1. As the photoreceptor 111B, for example, an organic photoreceptor having sensitivity to an infrared range is used.

A charging roller (charging unit) 118B is provided above the photoreceptor 111B, a predetermined voltage is applied to the charging roller 118B by a power supply (not shown), and a surface of the photoreceptor 111B is charged to a predetermined potential.

In the vicinity of the photoreceptor 111B, an exposure device (an example of electrostatic charge image forming unit) 119B that exposes a surface of the photoreceptor 111B to form an electrostatic charge image thereon is disposed downstream of the charging roller 118B in a rotating direction of the photoreceptor 111B.

Here, as the exposure device 119B, an LED array capable of realizing reduction in size is used, but the exemplary embodiment is not limited thereto. However, an electrostatic charge image forming unit using another laser beam or the like may be used. The wavelength of the light source is not limited and it is preferable in a spectral sensitivity range of the photoreceptor. For example, in a case where a semiconductor laser is used, the semiconductor laser may be a near infrared semiconductor laser having an oscillation wavelength of 780 nm but is not limited thereto. For example, a laser having an oscillation wavelength of about 600 nm, or a blue laser having an oscillation wavelength of 400 nm to 450 nm may be used. In addition, a surface emission laser light source capable of emitting a multi-beam is also effective.

In the vicinity of the photoreceptor 111B, the developing device 120B (that is, the first developing unit), which accommodates the metallic first developer and includes a developer holding member holding the first developer, is disposed downstream of the exposure device 119B in the rotating direction of the photoreceptor 111B. An electrostatic charge image formed on the surface of the photoreceptor 111B is developed by the metallic toner accommodated in the developing device 120B, and a toner image (that is, the first toner image) is formed on the surface of the photoreceptor 111B.

The intermediate transfer belt 133 (that is, the transfer medium) to which the toner image formed on the surface of the photoreceptor 111B is primarily transferred is disposed below the photoreceptor 111B so as to extend across a region below the five photoreceptors 111B, 111Y, 111M, 111C, and 111K. The intermediate transfer belt 133 is pressed toward the surface of the photoreceptor 111B by the primary transfer roller 117B (that is, the first transfer unit).

In addition, the intermediate transfer belt 133 is supported by three rollers including a drive roller 112, a support roller 113, and a bias roller 114, and moves in a direction indicated by arrow B at the same moving speed as the process speed of the photoreceptor 111B. The drive roller 112 also functions an intermediate transfer member erasing unit that erases charges accumulated in the intermediate transfer belt 133.

After the metallic toner image (that is, the first toner image) is primarily transferred to the surface of the intermediate transfer belt 133, the toner images (that is, the second toner images) of the colors including yellow, magenta, cyan, and black formed by the units 150Y, 150M, 150C, and 150K are sequentially primarily transferred to the surface of the intermediate transfer belt 133. After the toner images of the colors are layered, charges of the intermediate transfer belt 133 are erased by the drive roller 112.

On a side of the intermediate transfer belt 133 opposite to the support roller 113, a belt cleaner 116 (that is, the cleaning member) that cleans an outer peripheral surface of the intermediate transfer belt 133 is provided to be pressed against the support roller 113. On an upstream side of the belt cleaner 116 in the rotating direction of the intermediate transfer belt 133, a voltage applying device 160 as a disposing unit is provided which generates an electric field between the belt cleaner 116 and the intermediate transfer belt 133 by generating a potential difference between the belt cleaner 116 and the support roller 113.

The intermediate transfer belt 133 may include a polyimide resin or a polyamide imide resin from the viewpoints of obtaining high strength of the intermediate transfer belt 133 itself and satisfying durability thereof. In addition, a surface resistivity of the intermediate transfer belt 133 is not limited and it is preferably from $1\times10^{9}$ Ω/sq to $1\times10^{14}$ Ω/sq. In order to control the surface resistivity, the intermediate transfer belt 133 optionally includes a conductive filler. As the conductive filler, one kind or a combination of two or more kinds selected from the following group may be used, the group including: a metal or an alloy such as carbon black, graphite, aluminum, or a copper alloy; a metal oxide such as tin oxide, zinc oxide, potassium titanate, a tin oxide-indium oxide complex oxide, or a tin oxide-antimony oxide complex oxide; and a conductive polymer such as polyaniline. Among these, carbon black is preferable as the conductive filler from the viewpoint of costs. In addition, a processing auxiliary agent such as a dispersant or a lubricant is optionally added.

In addition, in the vicinity of the photoreceptor 111B, a cleaning device 115B that cleans the toner remaining on the surface of the photoreceptor 111B or the toner retransferred thereto is disposed downstream of the primary transfer roller 117B in the rotating direction of the photoreceptor 111B (direction indicated by arrow A). As the cleaning device 115B, a cleaning blade type device is used. For example, a cleaning blade of the cleaning device 115B is attached and pressed to a surface of the photoreceptor 111B in a counter direction.

A material of the cleaning blade is not particularly limited, and various elastomers are used. Specific examples of the elastomer include a polyurethane elastomer, silicone rubber, and chloroprene rubber.

As the polyurethane elastomer, in general, polyurethanes that are synthesized through an addition reaction of isocyanate, polyol, and various hydrogen-containing compounds are used. Specifically, the polyurethane elastomer is manufactured by preparing a urethane prepolymer using a polyol component and an isocyanate component, adding a curing agent to the urethane prepolymer, injecting the compound into a mold, crosslinking and curing compound, and aging the cured product at a normal temperature (25° C.). In this case, examples of the polyol component include: an ether polyol such as polypropylene glycol or polytetramethylene glycol; an adipate polyol; a polycaprolactam polyol; and a polyester polyol such as a polycarbonate polyol. Examples of the isocyanate component include: an aromatic polyisocyanate such as tolylene diisocyanate, 4,4'-diphenylmethane diisocyanate, polymethylene polyphenyl polyisocyanate, or tolidine diisocyanate; and an aliphatic polyisocyanate such as hexamethylene diisocyanate, isophorone diisocyanate, xylylene diisocyanate, or dicyclohexylmethane diisocyanate. As the curing agent, typically, a dihydric alcohol such as 1,4-butanediol and a trihydric or higher polyhydric alcohol such as trimethylolpropane or pentaerythritol are used in combination.

In a case where a rubber hardness (according to durometer Type A of JIS K 6253-3:2012) of the cleaning blade is 50° or higher, the cleaning blade is not likely to be worn. Therefore, the toner is not likely to pass through the cleaning blade. In a case where the rubber hardness is 100° or lower, the cleaning blade is not excessively hard. Therefore, the wearing of the image holding member is not likely to progress, and cleaning performance is not likely to deteriorate.

In addition, in a case where a 300% modulus, which shows a tensile stress at a sample elongation of 300%, is 80 kgf/cm$^2$ or higher, a blade edge is not likely to be deformed and is not likely to be torn off. The cleaning blade has resistance to chipping or wearing, and the toner is not likely to pass through the cleaning blade. On the other hand, in a case where the 300% modulus is 550 kgf/cm$^2$ or lower, deterioration in followability with respect to a surface shape of the image holding member, which is caused by deformation of the cleaning blade, is not likely to occur. Therefore, cleaning failure caused by contact failure is not likely to occur.

Further, in the cleaning blade in which a rebound resilience defined by a rebound test method of JIS K 6255:1996 (hereinafter, simply referred to as "rebound resilience") is 4% or higher, a reciprocating motion of the blade edge scraping the toner is likely to occur. Therefore, the toner is not likely to pass through the cleaning blade. In addition, in the cleaning blade in which the rebound resilience is 85% or lower, blade squeal or blade turned-up is not likely to occur.

In addition, the amount of biting of the cleaning blade (the amount of the cleaning blade deformed by being pressed against the surface of the image holding member) is not unconditionally determined and is preferably from 0.8 mm to 1.6 mm and more preferably from 1.0 mm to 1.4 mm. Further, a contact angle between the cleaning blade and the image holding member (an angle between the cleaning blade and a tangent line of the surface of the image holding member) is not unconditionally determined and is preferably from 18° to 28°.

A secondary transfer roller (secondary transfer unit) 134 is pressed against the bias roller 114, which supports the intermediate transfer belt 133, through the intermediate transfer belt 133. In a nip portion between the bias roller 114 and the secondary transfer roller 134, the toner image primarily transferred and layered on the surface of the intermediate transfer belt 133 is electrostatically transferred to a surface of a recording sheet (recording medium) P supplied from a sheet cassette (not shown). At this time, since the metallic toner image is positioned on the lowermost side (lowermost layer) among the toner images transferred and layered on the intermediate transfer belt 133, the metallic toner image is positioned on the uppermost side (uppermost layer) among the toner images transferred to the surface of the recording sheet P.

In addition, a fixing unit (fixing unit) 135 that fixes the toner images, which are transferred and layered on the recording sheet P, on the surface of the recording sheet P by heat and pressure to form a fixed image is disposed downstream of the secondary transfer roller 134.

Examples of the fixing unit 135 include: a fixing belt having a belt shape in which a surface is formed of a low surface energy material such as a fluororesin component or a silicone resin; and a fixing roller having a cylindrical shape in which a surface is formed of a low surface energy material such as a fluororesin component or a silicone resin.

Next, operations of the units 150B, 150Y, 150M, 150C, and 150K that form color images of metallic color, yellow, magenta, cyan, and black will be described. The operations of the units 150B, 150Y, 150M, 150C, and 150K are the same, and thus the operation of the metallic image forming unit 150B will be described as a representative example.

In the metallic unit 150B, the photoreceptor 111B rotates in the direction indicated by arrow A at a predetermined process speed. A surface of the photoreceptor 111B is negatively charged to a predetermined potential by the charging roller 118B. Next, the surface of the photoreceptor 111B is exposed by the exposure device 119B to form an electrostatic charge image corresponding to image information. Next, the negatively charged toner is reversely developed by the developing device 120B, the electrostatic charge image formed on the surface of the photoreceptor 111B is visualized on the surface of the photoreceptor 111B, and a toner image is formed. Next, the toner image formed on the surface of the photoreceptor 111B is primarily transferred to a surface of the intermediate transfer belt 133 by the primary transfer roller 117B. After the primary transfer, a transfer remaining component such as the toner remaining in the surface of the photoreceptor 111B is scraped and cleaned by the cleaning blade of the cleaning device 115B for the next image forming step.

The above-described operations are performed by the units 150B, 150Y, 150M, 150C, and 150K. The toner images visualized on the surfaces of the photoreceptors 111B, 111Y, 111M, 111C, and 111K are sequentially transferred and layered on a surface of the intermediate transfer belt 133. In addition, charges of the intermediate transfer belt 133 to which the toner image are transferred or transferred and layered are erased by the drive roller 112.

Next, the toner images transferred and layered on the surface of the intermediate transfer belt 133 are secondarily transferred to a surface of the recording sheet P by the secondary transfer roller 134, the recording sheet P being transported from the sheet cassette (not shown). Next, the toner images are fixed by being heated and pressed by the fixing unit 135. After the secondary transfer, the toner remaining on the surface of the intermediate transfer belt 133 is caused to rise to the surface of the intermediate transfer belt 133 by the voltage applying device 160 as a disposing unit that generates an electric field between the belt cleaner 116 and the intermediate transfer belt 133, and then is cleaned by the belt cleaner 116 constituting the cleaning blade for the intermediate transfer belt 133.

In the metallic image forming unit 150B, the developing device 120B including a developer holding member that holds a metallic electrostatic charge image developer, the photoreceptor 111B, the charging roller 118B, and the cleaning device 115B are integrated into a process cartridge that is detachable from the image forming apparatus main body. In addition, the image forming units 150Y, 150M, 150C, and 150K are also configured as process cartridges, respectively, as in the case of the image forming unit 150B.

Figure 2:
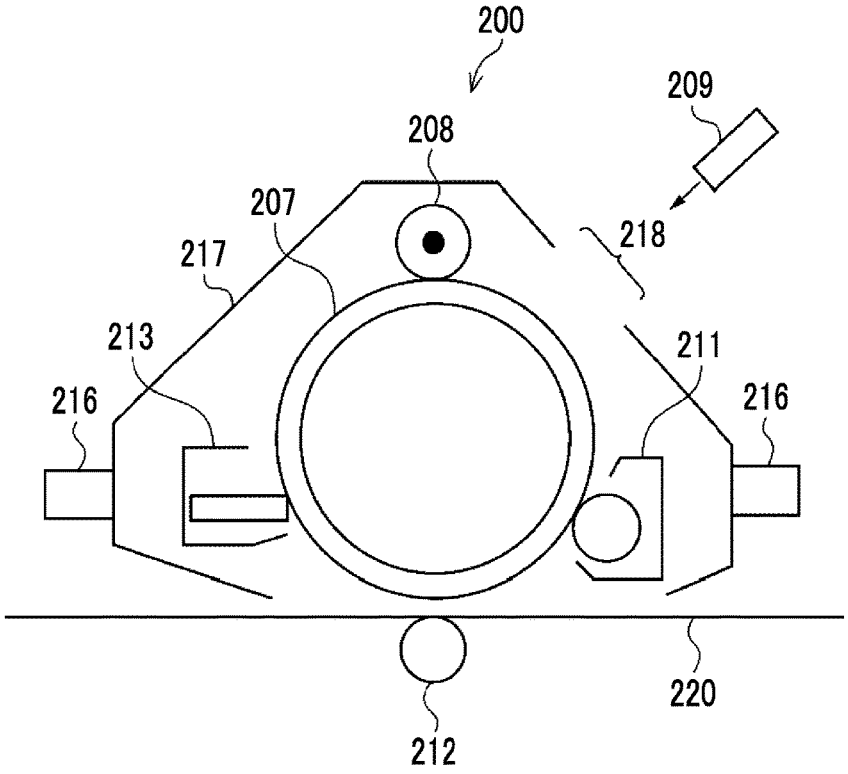
FIG. 2 is a diagram schematically showing a configuration example of a process cartridge according to an exemplary embodiment of the invention.

FIG. 2 shows an example of the process cartridge. However, the process cartridge is not limited to the configuration shown in FIG. 2. Major components shown in the drawings will be described, and the other components will not be described.

A process cartridge 200 shown in FIG. 2 is, for example, a cartridge in which a photoreceptor 207 (an example of the image holding member), and a charging roller 208 (an example of the charging unit), a developing device 211 (an example of the developing unit), and a photoreceptor cleaning device 213 (an example of the cleaning unit), which are provided around the photoreceptor 207 are integrally combined in a housing 217 including amounting rail 216 and an opening 218 for exposure.

In FIG. 2, reference numeral 209 represents an exposure device (an example of the electrostatic charge image forming unit), reference numeral 212 represents a primary transfer roller (an example of the primary transfer unit), and reference numeral 220 represents an intermediate transfer belt (an example of the intermediate transfer member).

The process cartridge is not limited to the above-described configuration, and may include the developing device and optionally at least one component selected from other units such as an image holding member, a charging unit, an electrostatic charge image forming unit, and a transfer unit.

In addition, the toner cartridges 140B, 140Y, 140M, 140C, and 140K include respective color toners, are detachable from the image forming apparatus, and are connected to the developing devices corresponding to the respective colors through toner supply pipes (not shown). In a case where the amount of the toner contained in each of the toner cartridges is insufficient, this toner cartridge is replaced with a new one.

In the exemplary embodiment, the charging rollers 118B, 118Y, 118M, 118C, and 118K is used as the charging devices. However, the exemplary embodiment is not limited to the example, and a well-known charging member, for example, a contact type charging member such as a charging brush, a charging film, a charging rubber blade, or a charging tube, a non-contact type roller charging member, or a scorotron charging member or a scorotron charging member using corona discharge may also be used.

In the exemplary embodiment, the primary transfer roller is used as the primary transfer unit and the secondary transfer roller is used as the secondary transfer unit. However, the exemplary embodiment is not limited to the example, and a well-known transfer charging member, for example, a contact type transfer charging member such as a belt, a film, or a rubber blade, or a scorotron transfer charging member or a scorotron transfer charging member using corona discharge may also be used.

In the image forming apparatus according to the exemplary embodiment, the disposing unit that causes the toner, which remains on the surface of the intermediate transfer member after the transfer, to rise to the surface of the intermediate transfer member is provided. However, a disposing unit that causes the toner, which remains on the surface of the image holding member after the transfer, to rise to the surface of the image holding member may be further provided, or the disposing units may not be provided In the exemplary embodiment, the image forming units 150K, 150C, 150M, 150Y, and 150B are disposed in this order from the downstream side in a rotating direction of an intermediate transfer belt 133. However, the exemplary embodiment is not limited to this configuration as long as the second unit is disposed downstream of the first unit. Specifically, for example, the image forming units 150B, 150K, 150C, 150M, and 150Y may be disposed in this order from the downstream side in a rotating direction of an intermediate transfer belt 133.

In the exemplary embodiment, the unit 150B as the first unit is disposed on the most upstream side in the rotating direction of the intermediate transfer belt 133 among all the units. However, the exemplary embodiment is not limited to the above-described embodiment, and other units may be further provided upstream of the first unit.

In the embodiment, among the five units, the first unit is disposed on the most upstream side, and the second unit is disposed on the second most upstream side in the rotating direction of the intermediate transfer belt 133. However, the exemplary embodiment is not limited to the above-described configurations, and another unit may be disposed on the second most upstream side.

In the embodiment, the units other than the first unit are the second units. However, the exemplary embodiment is not limited to the above-described embodiment, and units other than the first unit and the second unit may be further provided.

In the exemplary embodiment, the five units are disposed along the rotating direction of the intermediate transfer belt 133. However, the number of units may be two or more. It is preferable that the number of units is from 3 to 5.

In the exemplary embodiment, a brilliant toner is used as the first toner, but the exemplary embodiment is not limited thereto. As the first toner, a brilliant toner, a white toner, or a transparent toner is preferable, and a brilliant toner or a white toner is more preferable.

Developer Set

The developer set includes: a first developer that includes a first toner and a first carrier; and a second developer that includes a second toner and a second carrier, the second carrier having a low volume resistivity than the first carrier and having a smaller volume average particle diameter than the first carrier.

Here, in the developer set according to the exemplary embodiment, for example, the first toner is a toner that includes a flaky brilliant pigment, a toner that includes a white pigment, or a transparent toner.

The developer set may include plural second developers or may further include other developers.

A mixing ratio (mass ratio; toner:carrier) of the toner to the carrier in the each of developers varies depending on the kinds of the toner and the carrier to be used and is not particularly limited, and is preferably 1:100 to 30:100 and more preferably 3:100 to 20:100.

Carrier

Hereinafter, the details of the carriers (that is, the first carrier and the second carrier) used in the developer set according to the exemplary embodiment will be described.

The first carrier and the second carrier are not particularly limited as long as magnitude relationships of the volume resistivity and the volume average particle diameter satisfy the above-described conditions, and well-known carriers of the related art may be used. For example, a carrier including core particles and a resin coating layer that coats the core particles may be used.

Volume Resistivity of Carrier

The volume resistivity of the first carrier is higher than that of the second carrier.

Here, the volume resistivities of the carriers are volume resistivities at 20° C. and are measured using the following method.

The developer in the developing device is separated into the toner and the carrier by air blowing to extract the carrier therefrom. This operation may be repeated in order to sufficiently separate the carrier and the toner from each other. Next, the extracted carrier is placed flat on a surface of a circular jig on which a 20 $cm^2$ electrode plate is disposed such that the thickness thereof is from 1 mm to 3 mm, thereby forming a layer. Another 20 $cm^2$ electrode plate is disposed on the layer such that the layer is interposed between the electrode plates. In order to remove a gap in a measurement target, a load of 4 kg is applied to the electrode plate disposed above the layer, and then the thickness (cm) of the layer is measured. Both of the electrodes disposed above and below the layer are connected to an electrometer and a high-voltage power supply. A high voltage is applied to both the electrodes so as to generate an electric field of 103.8 V/cm, and a current value (A) flowing at this time is read. The measurement environment is an applied voltage of 1000 V, a temperature of 20° C., and a humidity of 50% RH. An expression of calculating the volume electric resistance (Ωcm) of the measurement target is as follows.

$$R=E\times 20/(I-I_0)/L$$

In the above expression, R represents the volume electric resistance (Ωcm) of the measurement target, E represents the applied voltage (V), I represents the current value (A), $I_0$ represents the current value (A) at an applied voltage of 0 V, and L represents the thickness (cm) of the layer. The coefficient 20 represents the area ($cm^2$) of the electrode plates.

The volume resistivity of the first carrier is not limited and it is preferably from 3.2 times to 50000 times, more preferably from 10 times to 45000 times, and still more preferably from 100 times to 40000 times with respect to the volume resistivity of the second carrier.

By adjusting a ratio (the volume resistivity of the first carrier/the volume resistivity of the second carrier) to be in the above-described range, carrier scattering caused by charge injection is suppressed as compared to a case where the ratio is lower than the above-described range, and density unevenness caused by a small development field is suppressed as compared to a case where the ratio is higher than the above-described range.

The volume resistivity of the second carrier is not limited and it is preferably from $1\times10^6$ Ωcm to $1\times10^{14}$ Ωcm, more preferably from $1\times10^7$ Ωcm to $1\times10^{12}$ Ωcm, and still more preferably from $1\times10^7$ Ωcm to $1\times10^9$ Ωcm.

In a case where the developer set includes plural second developers, the above-described preferable range may be applied to all the second carriers.

For example, in a case where each of the carriers is a carrier including core particles and a resin coating layer, the volume resistivity of the carrier is controlled by adjusting, for example, the treatment of core particles, the resin coating amount of the resin coating layer described below, the content of conductive particles in the resin coating layer, or a combination thereof described below.

In either the first carrier or the second carrier, the resin coating amount of the resin coating layer is, for example, 0.5% by mass or higher with respect to the total mass of the carrier (preferably from 0.7% by mass to 6.0% by mass and more preferably from 1.0% by mass to 5.0% by mass).

As the resin coating amount of the resin coating layer increases, the volume resistivity of the carrier increases. Therefore, in a case where the volume resistivity of the carrier is controlled by adjusting the resin coating amount of the resin coating layer, for example, the resin coating amount of the first carrier is larger than that of the second carrier.

The resin coating amount of the resin coating layer is obtained as follows.

In the case of a resin coating layer that is soluble in a solvent, a carrier that is accurately weighed is dissolved in a solvent (for example, toluene or N-methylpyrrolidone) in which the resin coating layer is soluble, the core particles are held with a magnet, and the solution in which the resin coating layer is dissolved is drained away. By repeating this operation several times, core particles from which the resin coating layer is removed remain. The mass of the core particles after being dried is measured, and then the difference is divided by the amount of a carrier to calculate the coating amount.

Specifically, 20.0 g of a carrier is weighed and put into a beaker, 100 g of toluene is added thereto, and the mixture is stirred with a stirring blade for 10 minutes. A magnet is placed under the bottom of the beaker, and the toluene is drained away such that the core particles do not flow out. This operation is repeated four times, and the beaker after the toluene is drained away is dried. The amount of the magnetic particles after the drying is measured, and the coating amount is calculated from the expression "(Carrier Amount−Amount of Core Particles After Washing)/Carrier Amount".

On the other hand, in the case of a coating layer that is insoluble in a solvent, a carrier is heated in a nitrogen atmosphere in a range of room temperature (25° C.) to 1,000° C. using a Thermo plus EVO II differential thermogravimetric analyzer TG 8120 (manufactured by Rigaku Corporation). The resin coating amount is calculated from a decrease in the mass of the carrier.

In a case where the resin coating layer includes conductive particles, the content of the conductive particles in the resin coating layer is, for example, from 0.1% by mass to 50% by mass, preferably from 0.15% by mass to 20% by mass, and more preferably from 0.3% by mass to 10% by mass.

As the content of the conductive particles in the resin coating layer increases, the volume resistivity of the carrier decreases. Therefore, in a case where the volume resistivity of the carrier is controlled by adjusting the content of the conductive particles in the resin coating layer, for example, the content of the conductive particles in the resin coating layer of the first carrier is lower than (or 0% by mass) that of the conductive particles in the resin coating layer of the second carrier.

Volume Average Particle Diameter of Carrier

The volume average particle diameter of the first carrier is more than that of the second carrier.

Here, the volume average particle diameters of the carriers are measured using the following method. The volume average particle diameter of the core particles is also measured as follows.

Using a laser scattering diffraction particle diameter distribution analyzer (LS particle size analyzer, manufactured by Beckman Coulter Co., Ltd.), a particle diameter distribution is measured. As an electrolytic solution, ISOTON-II (manufactured by Beckman Coulter Co., Ltd.) is used. The number of particles to be measured is 50,000.

Using the measured particle diameter distribution, a volume cumulative particle diameter distribution is drawn on divided particle diameter ranges (channels) from the smallest particle diameter. A particle diameter having a cumulative value of 50% by volume (also referred to as "D50v") is defined as "volume average particle diameter".

The volume average particle diameter of each of the carriers is obtained by performing the above-described measurement on the carrier that is extracted after separating the developer in the developing device into the toner and the carrier by air blowing.

The volume average particle diameter of the first carrier is, for example, preferably from 1.1 times to 2.0 times, more preferably from 1.2 times to 1.9 times, and still more preferably from 1.4 times to 1.8 times with respect to the volume average particle diameter of the second carrier.

By adjusting a ratio (the volume average particle diameter of the first carrier/the volume average particle diameter of the second carrier) to be in the above-described range, the formation of a white line is more likely to be suppressed as compared to a case where the ratio is lower than the above-described range, and unevenness in image density caused by an unstable state of a magnetic brush is suppressed as compared to a case where the ratio is higher than the above-described range.

The volume average particle diameter of the second carrier is not limited and it is preferably from 10 μm to 500 μm, more preferably from 20 μm to 60 μm, and still more preferably from 30 μm to 35 μm.

In a case where the developer set includes plural second developers, the above-described preferable range may be applied to all the second carriers.

For example, in a case where each of the carriers is a carrier including core particles and a resin coating layer, the volume average particle diameter of the carrier is controlled by adjusting, for example, the volume average particle diameter of the core particles, the thickness of the resin coating layer, or a combination thereof.

Hereinafter, common configurations of the first carrier and the second carrier will be described.

Core Particles

Examples of the core particles according to the exemplary embodiment include magnetic metal particles (for example, particles of iron, steel, nickel, or cobalt), magnetic oxide particles (for example, particles of ferrite or magnetite), and magnetic particle-dispersed resin particles in which the above particles are dispersed in a resin. In addition, examples of the core particles include particles obtained by impregnating porous magnetic particles with a resin.

It is preferable that the core particles be ferrite particles represented by, for example, the following formula.

$$(MO)X(Fe_2O_3)Y \qquad \text{Formula:}$$

In the formula, Y represents 2.1 to 2.4, and X represents 3−Y. M represents a metal element and preferably contains at least Mn as the metal element.

M contains Mn as a major component and may further contain at least one element selected from the group consisting of Li, Ca, Sr, Sn, Cu, Zn, Ba, Mg, and Ti (preferably, the group consisting of Li, Ca, Sr, Mg, and Ti from the viewpoint of the environment).

The core particles are obtained by magnetic granulation or sintering, and as a pre-treatment, the magnetic materials may be pulverized. A pulverization method is not particularly limited. For example, a well-known pulverization method may be used, and specific examples thereof include methods using a mortar, a ball mill, and a jet mill.

The resin included in the magnetic particle-dispersed resin particles which are the core particles is not particularly limited, and examples thereof include styrene resins, acrylic resins, phenol resins, melamine resins, epoxy resins, urethane resins, polyester resins, and silicone resins. In addition, optionally, other components such as a charge-controlling agent or fluorine-containing particles may be further added to the magnetic particle-dispersed resin particles which are the core particle.

A volume average particle diameter of the core particles is, for example, from 10 μm to 500 μm, and is preferably from 15 μm to 80 μm and more preferably from 20 μm to 60 μm.

In a case where the volume resistivity of the carrier is controlled by adjusting the treatment of the core particles, for example, the volume resistivity may be controlled by performing an oxidation treatment on the core particles. Specifically, by performing an oxidation treatment on the core particle, the volume resistivity tends to increase. By using the core particles on which the oxidation treatment is performed, the volume resistivity of the carrier is easily controlled. In the oxidation treatment, an oxygen concentration, an oxidation temperature, and a heating time are control factors of the volume resistivity. For example, in the oxidation treatment that is performed on the core particles, the volume resistivity of the core particles tends to increase by increasing the oxidation temperature or by increasing the heating time. Specifically, the oxidation treatment is performed on the core particles used in the first carrier, and the oxidation treatment is not performed on the core particles used in the second carrier or is performed at a lower temperature or for a shorter time than that of the core particles of the first carrier such that the two carriers used in the developer set according to the exemplary embodiment are obtained.

Resin Coating Layer

Examples of the coating resin of the resin coating layer include acrylic resins, polyethylene resins, polypropylene resins, polystyrene resins, polyacrylonitrile resins, polyvinylacetate resins, polyvinylalcohol resins, polyvinylbutyral resins, polyvinyl chloride resins, polyvinyl carbazole resins, polyvinyl ether resins, polyvinyl ketone resins, vinyl chloride-vinyl acetate copolymers, styrene-acrylic acid ester copolymers, straight silicone resins having an organosiloxane bond and modified compounds thereof, fluororesins, polyester resins, polyurethane resins, polycarbonate resins, phenol resins, amino resins, melamine resins, benzoguanamine resins, urea resins, amide resins, and epoxy resins.

The resin coating layer may further contain resin particles for the purposes of charge control and the like, or may further contain conductive particles for the purposes of resistance control and the like. The coating layer may further include other additives.

The resin particles are not particularly limited. For example, a charge-controlling material is preferable, and examples thereof include melamine resin particles, urea resin particles, urethane resin particles, polyester resin particles, and acrylic resin particles.

Examples of the conductive particles include carbon black particles, various metal powders, and metal oxide particles (for example, particles of titanium oxide, tin oxide, magnetite, and ferrite). Among these, one kind may be used alone, two or more kinds may be used in combination. Among these, carbon black particles are preferably used from the viewpoints of manufacturing stability, cost, conductivity, and the like. The kind of the carbon black is not particularly limited. For example, carbon black having a DBP absorption of, approximately, 50 ml/100 g to 250 ml/100 g is preferably used from the viewpoint of manufacturing stability.

A method of forming the resin coating layer on the surfaces of the core particles is not particularly limited, and a well-known method may be adopted. Examples of the method include a dipping method in which a resin coating layer-forming solution is prepared, and the core particles are dipped in the resin coating layer-forming solution; a spray method in which a resin coating layer-forming solution is sprayed on the surfaces of the core particles; a fluidized bed method in which a resin coating layer-forming solution is sprayed on the core particles while floating the core particles with flowing air; a kneader coater method in which the core particles and a resin coating layer-forming solution are mixed in a kneader coater, and then a solvent is removed; and a powder coating method in which the core particles and resin powder are heated and mixed. Further, after being formed, the resin coating layer may be heated using a device such as an electric furnace or a kiln.

Other Properties of Carrier

Regarding the magnetic force of the carrier, the saturation magnetization at a magnetic field of 1000 oersted may be, for example, 40 emu/g or higher or 50 emu/g or higher.

Here, the saturation magnetization of the carrier is measured using a vibrating sample magnetometer VSMP10-15 (manufactured by Toei Industry Co., Ltd.). A measurement sample is put into a cell having an internal diameter of 7 mm and a height of 5 mm, and the cell is set to the device. In the measurement, a magnetic field is applied to the sample and is swept to 3,000 oersted at a maximum. Next, the applied magnetic field is reduced to prepare a hysteresis curve on a recording sheet. Based on this curve data, the saturation magnetization is obtained.

Toner

The first toner and the second toner are not particularly limited, and compositions and physical properties thereof are the same as or different from each other.

Examples of a combination of the first toner and the second toner include a combination of the first toner that is a brilliant toner, a white toner, or a transparent toner and the second toner that is a yellow toner, a magenta toner, a cyan toner, or a black toner. In the developer set used in the image forming apparatus including plural second units, plural kinds of second toners may be used.

Dielectric Loss Tangent of Toner

Dielectric loss tangents of the first toner and the second toner are not particularly limited, and it is preferable that the dielectric loss tangent of the first toner is higher than that of the second toner.

That is, it is preferable that the first developer that includes the first toner having a relatively high dielectric loss tangent and the first carrier having a relatively high resistance and a relatively large particle diameter is used in combination with the second developer that includes the second toner having a relatively low dielectric loss tangent and the second carrier having a relatively low resistance and a relatively small particle diameter.

The dielectric loss tangent of the toner varies depending on the composition of the toner or the dispersed state of a colorant. In particular, the dielectric loss tangent of the toner largely depends on the kind of a colorant to be used. For example, in the case of a brilliant toner in which a brilliant pigment is used as a colorant and a white toner in which a white pigment is used as a colorant, the dielectric loss tangent is more likely to be higher than those of the other toners (for example, a yellow toner, a magenta toner, a cyan toner, a black toner, and a transparent toner).

Here, the dielectric loss tangent (tan δ) of the toner is expressed as a ratio of an imaginary part ε" to a real part ε' in "complex dielectric constant $\varepsilon=\varepsilon'-i\varepsilon''$" (i represents an imaginary unit), and is expressed by "dielectric loss tangent $(\tan\delta)=\varepsilon''/\varepsilon'$.

The dielectric loss tangent (tan δ) of the toner is obtained as follows. For example, 5 g of a toner as a measurement target is molded into a pellet (diameter: 50 mm) using a pressure molding machine, and the pellet is seasoned in an environment of 20° C. and 50% RH for 17 hours. Next, the dielectric loss tangent is measured using an LCR meter (LCR meter 6440A, manufactured by Toyo Corporation) in an environment of 20° C. and 50% RH under conditions of frequency: 1 kHz and voltage: 5 V.

The dielectric loss tangent of the first toner is, for example, preferably from 1.5 times to 5.0 times, more preferably from 1.8 times to 4.5 times, and still more preferably from 2.0 times to 3.7 times with respect to the dielectric loss tangent of the second toner.

In addition, the dielectric loss tangent of the first toner is not limited and it is preferably from $30\times10^{-3}$ to $70\times10^{-3}$, more preferably from $40\times10^{-3}$ to $65\times10^{-3}$, and still more preferably from $45\times10^{-3}$ to $65\times10^{-3}$.

In a case where the developer set includes plural second developers, the above-described preferable range may be applied to all the second toners.

Hereinafter, the details of the first toner and the second toner will be described.

First, a general toner (for example, a yellow toner, a magenta toner, a cyan toner, or a black toner) which is used as the second toner will be described.

The toner includes toner particles and optionally further contains an external additive.

Toner Particles

The toner particles include, for example, a binder resin and optionally further contains a colorant, a release agent, and other additives.

Binder Resin

Examples of the binder resin include vinyl resins made of a homopolymer of one monomer or copolymers of two or more monomers selected from the following monomers: styrenes (for example, styrene, parachlorostyrene, and α-methylstyrene); (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate); ethylenically unsaturated nitriles (for example, acrylonitrile and methacrylonitrile); vinyl ethers (for example, vinyl methyl ether and vinyl isobutyl ether); vinyl ketones (vinyl methyl ketone, vinyl ethyl ketone, and vinyl isopropenyl ketone); and olefins (for example, ethylene, propylene, and butadiene).

Examples of the binder resin include non-vinyl resins such as epoxy resins, polyester resins, polyurethane resins, polyamide resins, cellulose resins, polyether resins, and modified rosins; mixtures of the non-vinyl resins and the vinyl resins; and graft polymers obtained by polymerization of vinyl monomers in the presence of the non-vinyl resins.

Among these binder resins, one kind may be used alone, two or more kinds may be used in combination.

The content of the binder resin is, for example, preferably from 40% by mass to 95% by mass, more preferably from 50% by mass to 90% by mass, and still more preferably from 60% by mass to 85% by mass with respect to the total amount of the toner particles.

Colorant

Examples of the colorant include various kinds of pigments such as carbon black, chrome yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

Among these colorants, one kind may be used alone, two or more kinds may be used in combination.

Optionally, the colorant may be surface-treated, or may be used in combination with a dispersant. In addition, plural kinds of colorants may be used in combination.

The content of the colorant is, for example, preferably from 1% by mass to 30% by mass and more preferably from 3% by mass to 15% by mass with respect to the total amount of the toner particles.

Release Agent

Examples of the release agent include hydrocarbon waxes; natural waxes such as carnauba wax, rice wax, and candelilla wax; synthetic or mineral and petroleum waxes such as montan wax; and ester waxes such as fatty acid ester and montanic acid ester. The release agent is not limited to these examples.

The melting temperature of the release agent is not limited and it is preferably from 50° C. to 110° C. and more preferably from 60° C. to 100° C.

The melting temperature is calculated from the DSC curve obtained from differential scanning calorimetry (DSC) according to a "melting peak temperature" described in a method of calculating melting temperature in "Testing methods for transition temperatures of plastics" of JIS K 7121-1987.

The content of the release agent is, for example, preferably from 1% by mass to 20% by mass and more preferably from 5% by mass to 15% by mass with respect to the total amount of the toner particles.

Other Additives

Examples of the other additives include various additives such as a magnetic material, a charge-controlling agent, and inorganic powder. These additives are included in the toner particles as internal additives.

Properties of Toner Particles

The toner particles may have a single-layer structure or a so-called core-shell structure including: a core (core particle) and a coating layer (shell layer) that coats the core.

Here, it is preferable that the toner particles having a core-shell structure include: a core that includes a binder resin and optionally further includes other additives such as a colorant and a release agent; and a coating layer that includes a binder resin, for example.

The volume average particle diameter (D50v) of the toner particles is not limited and it is preferably from 2 μm to 10 μm and more preferably from 4 μm to 8 μm.

Various average particle diameters and various particle diameter distribution indices of the toner particles are measured by using Coulter MULTISIZER II (manufactured by Beckman Coulter Inc.) as a measuring device and using ISOTON-II (manufactured by Beckman Coulter Co., Ltd.) as an electrolytic solution.

During this measurement, from 0.5 mg to 50 mg of a measurement sample is added to 2 ml of an aqueous solution containing 5% of a surfactant (for example, preferably, sodium alkylbenzene sulfonate) as a dispersant. This solution is added to 100 ml to 150 ml of the electrolytic solution.

The electrolytic solution in which the measurement sample is suspended is dispersed with an ultrasonic disperser for 1 minute. Then, a particle diameter distribution of particles having a particle diameter in a range of 2 μm to 60 μm is measured using COULTER MULTISIZER II and an aperture having an aperture size of 100 μm. The number of particles to be sampled is 50000.

Using the measured particle diameter distribution, volume and number cumulative particle diameter distributions are drawn on divided particle diameter ranges (channels) in order from the smallest particle diameter. In addition, particle diameters having cumulative values of 16% by volume and number are defined as a volume average particle diameter D16v and a number average particle diameter D16p, respectively. Particle diameters having cumulative values of 50% by volume and number are defined as a volume average particle diameter D50v and a number average particle diameter D50p, respectively. Particle diameters having cumulative values of 84% by volume and number are defined as a volume average particle diameter D84v and a number average particle diameter D84p, respectively.

Using these values, a volume average particle diameter distribution index (GSDv) is calculated from $(D84v/D16v)^{1/2}$, and a number average particle diameter distribution index (GSDp) is calculated from $(D84p/D16p)^{1/2}$.

An average circularity of the toner particles is not limited and it is preferably from 0.94 to 1.00 and more preferably from 0.95 to 0.98.

The average circularity of the toner particles is obtained from "(equivalent circle peripheral length)/(peripheral length) [(peripheral length of circle having the same projected area of particle image)/(peripheral length of particle projected image)]". Specifically, the average circularity is a value measured using the following method.

First, toner particles as a measurement target are collected by suction, a flat flow is formed, and particle images are obtained as still images by instantaneous stroboscopic light emission. The particle images are analyzed using a flow particle image analyzer (FPIA-3000, manufactured by Sysmex Corporation). As a result, the average circularity is obtained. The number of samples for obtaining the average circularity is 3500.

In a case where a toner includes an external additive, the toner (developer) as a measurement target is dispersed in water including a surfactant, and then the external additive is removed by an ultrasonic treatment. As a result, toner particles are obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

Surfaces of the inorganic particles as the external additive may be treated with a hydrophobizing agent. The hydrophobization treatment may be performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. Among these, one kind may be used alone, two or more kinds may be used in combination.

The amount of the hydrophobizing agent is from 1 part by mass to 10 parts by mass with respect to 100 parts by mass of the inorganic particles.

Examples of the external additive include resin particles (for example, resin particles of polystyrene, polymethyl methacrylate (PMMA), and melamine resin) and a cleaning aid (for example, particles of metal salts of higher fatty acids such as zinc stearate and fluorine polymers).

The content of the external additive is, for example, preferably from 0.01% by mass to 5% by mass and more preferably from 0.01% by mass to 2.0% by mass with respect to the total amount of the toner particles.

Method of Preparing Toner

Next, a method of preparing a toner will be described.

The toner is obtained by preparing the toner particles and externally adding the external additive to the toner particles.

The toner particles may be prepared using either a dry method (for example, a kneading and pulverizing method) or a wet method (for example, an aggregating and coalescing method, a suspension and polymerization method, or a dissolution and suspension method). The method of preparing the toner particles is not limited to these methods, and a well-known method is adopted.

Among these, an aggregating and coalescing method is preferably used to obtain the toner particles.

Specifically, for example, in a case where toner particles are prepared using the aggregating and coalescing method, the toner particles are prepared through the following processes including: a process (resin particle dispersion preparing process) of preparing a resin particle dispersion in which resin particles which form a binder resin are dispersed; a process (aggregated particle forming process) of forming aggregated particles by aggregating the resin particles (optionally, including other particles) in the resin particle dispersion (optionally in a dispersion in which the resin particle dispersion is mixed with another particle dispersion); and a process (coalescing process) of forming toner particles by heating an aggregated particle dispersion in which the aggregated particles are dispersed to coalesce the aggregated particles.

Toner particles may be prepared through the following processes including: a process of forming second aggregated particles by obtaining an aggregated particle dispersion in which aggregated particles are dispersed, and then further mixing the aggregated particle dispersion with a resin particle dispersion in which resin particles are dispersed so as to attach the resin particles to surfaces of the aggregated particles; and a process of forming toner particles having a core-shell structure by heating a second aggregated particle dispersion in which the second aggregated particles are dispersed to coalesce the second aggregated particles.

Here, after the coalescing process ends, toner particles formed in the solution undergo well-known processes including a washing process, a solid-liquid separation process, and a drying process. As a result, dry toner particles are obtained.

In the washing process, although there is no particular limitation, it is preferable that displacement washing using ion exchange water is sufficiently performed from the viewpoint of charging characteristics. In addition, in the solid-liquid separation process, although there is no particular limitation, it is preferable that suction filtration, pressure filtration, or the like is performed from the viewpoint of productivity. In addition, in the drying process, although there is no particular limitation, it is preferable that freeze drying, flash drying, fluidized drying, vibration-type fluidized drying, or the like is performed from the viewpoint of productivity.

The toner is prepared, for example, by adding the external additive to the obtained dry toner particles and mixing them with each other. It is preferable that the mixing is performed using a V blender, HENSCHEL MIXER, or LODIGE MIXER. Further, optionally, coarse particles of the toner are removed, for example, using a vibration sieve or a wind classifier.

Brilliant Toner

Next, a brilliant toner which is used as the first toner will be described.

Examples of the brilliant toner include a toner including: toner particles that include a flaky brilliant pigment and a binder resin; and an external additive. The toner particles optionally include a release agent, a colorant other than the brilliant pigment, and other additives.

Since the details of the binder resin, the external additive, the release agent, the colorant other than the brilliant pigment, and the other additives are as described above regarding the toner (that is, the yellow toner or the like used as the second toner), the description thereof will not be repeated. In addition, the description of the same features as described above regarding the toner will not be repeated.

Brilliant Pigment

Examples of the brilliant pigment include a pigment (brilliant pigment) capable of imparting brilliance such as metallic gloss. The brilliant pigment is not particularly limited as long as it has brilliance, and examples thereof include powders of metals such as aluminum (elemental Al), brass, bronze, nickel, stainless steel, or zinc; micas coated with titanium oxide, yellow iron oxide, or the like; flaky inorganic crystal substrates coated with barium sulfate, layered silicate, layered aluminosilicate, or the like; single-crystal plate-like titanium oxides; basic carbonates; bismuth oxychlorides; natural guanines; flaky glass powders; and metal-deposited flaky glass powders.

Among these brilliant pigments, from the viewpoint of mirror reflection intensity, a metal powder is preferable, and aluminum powder is most preferable.

Examples of the brilliant pigment include a flake shape.

The average length of the brilliant pigment in the long axis direction is not limited and it is preferably from 1 μm to 30 μm, more preferably from 3 μm to 20 μm, and still more preferably from 5 μm to 15 μm.

A ratio (aspect ratio) of the average length of the brilliant pigment in the long axis direction to the average length of the brilliant pigment in the thickness direction, which is 1, is, for example, preferably from 5 to 200, more preferably from 10 to 100, and still more preferably from 30 to 70.

The average length and the aspect ratio of the brilliant pigment are measured using the following method. Using a scanning electron microscope (S-4800, manufactured by Hitachi High-Technologies Corporation), images of pigment particles are obtained at a measurement magnification (300 times to 100,000 times). In a state where the obtained images of the pigment particles are two-dimensionalized, the lengths of the particles in the long axis direction and the lengths of the particles in the thickness direction are measured, and the average length in the long axis direction and the aspect ratio of the brilliant pigment are calculated.

The content of the brilliant pigment is, for example, preferably from 1 part by mass to 50 parts by mass and more preferably from 15 parts by mass to 25 parts by mass with respect to 100 parts by mass of the toner particles.

Properties of Toner Particles

The toner particles may have a single-layer structure or a so-called core-shell structure including: a core (core particle) and a coating layer (shell layer) that coats the core.

For example, it is preferable that the toner particles having a core-shell structure include: a core that includes a brilliant pigment and a binder resin and optionally further includes other additives such as a release agent; and a coating layer that includes a binder resin.

Average Maximum Thickness C and Average Equivalent Circle Diameter D of Toner Particles It is, for example, preferable that the toner particles have a flake shape and has a structure in which an average equivalent circle diameter D is longer than an average maximum thickness C. A ratio (C/D) of the average maximum thickness C to the average equivalent circle diameter D is, for example, preferably from 0.001 to 0.500, more preferably from 0.010 to 0.200, and still more preferably from 0.050 to 0.100.

By adjusting the ratio (C/D) to 0.001 or higher, the strength of the toner is secured, breakage caused by stress during the formation of an image is reduced, a decrease in charging characteristics caused by exposure of the pigment is reduced, and fogging caused by the decrease in charging characteristics is reduced. On the other hand, by adjusting the ratio (C/D) to 0.500 or lower, satisfactory brilliance is obtained.

The average maximum thickness C and the average equivalent circle diameter D are measured using the following method.

The toner particles are placed on a smooth surface and are uniformly dispersed by vibration. 1000 toner particles are observed using a color laser microscope "VK-9700" (manufactured by Keyence Corporation) at a magnification of 1000 times to measure the maximum thicknesses C and the equivalent circle diameters D of the brilliant toner particles in a top view, and the average values thereof are obtained.

Angle between Long Axis Direction of Brilliant Pigment and Long Axis Direction of Cross-Sections of Toner Particles In a case where cross-sections of the toner particles in a thickness direction are observed, a ratio (by number) of the brilliant pigment particles whose long axis direction has an angle of −30° to +30° with respect to a long axis direction of the cross-sections of the toner particles to all the observed brilliant pigment particles is, for example, preferably 60% or higher. Further, the ratio is more preferably from 70% to 95% and still more preferably from 80% to 90%.

By adjusting the ratio to 60% or higher, satisfactory brilliance is obtained.

Here, a method of observing the cross-sections of the toner particles will be described.

The toner particles are embedded in a bisphenol A liquid epoxy resin and a curing agent to prepare a sample for cutting. Next, using a cutting machine with a diamond knife (for example, an ultramicrotome (Ultracut UCT, manufactured by Leica)), the sample for cutting is cut at −100° C. to prepare a sample for observation. Using a high-resolution field emission scanning electron microscope (S-4800, manufactured by Hitachi High-Technologies Corporation), the sample for observation is observed at a magnification at which 1 to 10 toner particles are observed in one field of view.

Specifically, 100 toner particles in cross-sections of the toner particles (cross-sections in the thickness direction of the toner particles) are observed. Regarding the observed 100 toner particles, the number of brilliant pigment particles whose long axis direction has an angle of −30° to +30° with respect to a long axis direction of the cross-sections of the toner particles are counted, for example, using an image analysis software such as WinROOF (manufactured by Mitani Corporation) or using an output sample of an observed image and a protractor to calculate the ratio thereof.

"The long axis direction of the cross-sections of the toner particles" refers to a direction perpendicular to the thickness direction of the toner particles in which the average equivalent circle diameter D is longer than the average maximum thickness C. In addition, "the long axis direction of the brilliant pigment" refers to a length direction of the brilliant pigment.

Volume Average Particle Diameter of Toner Particles

The volume average particle diameter of the toner particles is not limited and it is preferably from 1 μm to 30 μm and more preferably from 3 μm to 20 μm.

White Toner

Next, a white toner which is preferably used as the first toner will be described.

Examples of the white toner include a toner including: toner particles that include a white pigment and a binder resin; and an external additive. The toner particles optionally include a release agent and other additives.

Since the details of the binder resin, the external additive, the release agent, and the other additives are as described above regarding the toner (that is, the yellow toner or the like used as the second toner), the description thereof will not be repeated. In addition, the description of the same features as described above regarding the toner will not be repeated.

White Pigment

The white pigment is not particularly limited as long as it is white, and examples thereof include: an inorganic pigment (for example, titanium oxide, barium sulfate, lead oxide, zinc oxide, lead titanate, potassium titanate, barium titanate, strontium titanate, zirconia, antimony trioxide, lead white, zinc sulfide, or barium carbonate); and an organic pigment (for example, a polystyrene resin, a urea formalin resin, a polyacrylic resin, a polystyrene-acrylic resin, a polystyrene-butadiene resin, or an alkyl bis melamine resin).

In addition, a pigment having a hollow structure may be used. Examples of the pigment having a hollow structure include: a hollow inorganic pigment (for example, hollow silica, hollow titanium oxide, hollow calcium carbonate, hollow zinc oxide, or zinc oxide tubular particles); and hollow organic particles (for example, a styrene resin, an acrylic resin, a styrene-acrylic resin, a styrene-acrylic acid ester-acrylic acid resin, a styrene-butadiene resin, a styrene-methyl methacrylate-butadiene resin, an ethylene-vinyl acetate resin, an acrylic acid-vinyl acetate resin, or an acrylic acid-maleic acid resin).

Further, for example, heavy calcium carbonate, light calcium carbonate, aluminum hydroxide, satin white, talc, calcium sulfate, magnesium oxide, magnesium carbonate, amorphous silica, colloidal silica, white carbon, kaolin, calcined kaolin, delaminated kaolin, aluminosilicate, sericite, bentonite, or smectite may also be used.

Among these, titanium oxide or zinc oxide is preferable as the white pigment.

As the white pigment, one kind may be used alone, or two or more kinds may be used in combination.

Optionally, the white pigment may be surface-treated, or may be used in combination with a dispersant.

It is preferable that the content of the white pigment is, for example, from 10 parts by mass to 50 parts by mass with respect to 100 parts by mass of the toner particles. In a case where the content of the white pigment is 10 parts by mass or higher, whiteness and covering properties are likely to be exhibited. On the other hand, in a case where the content of the white pigment is 50 parts by mass or lower, the area of an interface between the white pigment and the binder resin does not increase beyond necessity. Therefore, the white toner image is not likely to be destructed, and an effect of suppressing image destruction is likely to be improved.

The content of the white pigment is, for example, preferably from 20 part by mass to 50 parts by mass and more preferably from 25 parts by mass to 45 parts by mass with respect to 100 parts by mass of the toner particles.

The number average particle diameter of the white pigment is, for example, from 200 nm to 400 nm. In a case where the number average particle diameter of the white pigment is from 200 nm to 400 nm, high whiteness and covering properties are exhibited. The number average particle diameter of the white pigment is preferably 250 nm to 400 nm and more preferably 250 nm to 350 nm.

A particle diameter distribution of the white pigment in the toner particles is calculated, for example, as follows.

The white toner is mixed with and embedded in an epoxy resin, and the mixture is kept overnight to be solidified. Next, using an ultramicrotome (Ultracut UCT, manufactured by Leica), a test piece having a thickness of, for example, from 250 nm to 450 nm is prepared.

The obtained test piece is observed using a high-resolution field emission scanning electron microscope (S-4800, manufactured by Hitachi High-Technologies Corporation) to examine the white pigment in the toner particles.

The obtained image is converted into digital data, the digital data is input to an image analysis software (WinROOF, manufactured by Mitani Corporation), and the number average particle diameter of the white pigment in the toner particles is obtained.

Transparent Toner

Next, a transparent toner (clear toner) which is used as the first toner will be described.

The transparent toner includes no colorants or 1.0% by mass or lower of a colorant with respect to the amount of toner particles.

Examples of the transparent toner include a toner including: toner particles that include 1.0% by mass or lower of a colorant with respect to the total amount of the toner particles; and an external additive. The toner particles optionally include a release agent and other additives.

The content of the colorant is not limited and it is preferably 1.0% by mass or lower, more preferably 0.5% by mass or lower, and most preferably 0% by mass with respect to the total amount of the toner particles in the transparent toner.

Since the details of the binder resin, the external additive, the release agent, and the other additives are as described above regarding the toner (that is, the yellow toner or the like used as the second toner), the description thereof will not be repeated. In addition, the description of the same features as described above regarding the toner will not be repeated.

EXAMPLES

Hereinafter, the exemplary embodiment will be described in detail using Examples but is not limited to these examples. In the following description, unless specified otherwise, "part(s)" and "%" represent "part(s) by mass" and "% by mass".

Preparation of Carrier

Preparation of Carrier 1-1

Mn—Mg ferrite particles (volume average particle diameter: 43 μm): 100 parts

Cyclohexyl methacrylate/methyl methacrylate copolymer: 3 parts (copolymer molar ratio: 95:5)

Toluene: 14 parts

Among the components constituting the carrier composition, the respective particles other than the Mn—Mg ferrite particles and glass beads (φ1 mm, the same amount as that of toluene) are stirred using a sand mill (manufactured by Kansai Paint Co., Ltd.) at 1200 ppm for 30 minutes. As a result, a resin coating layer-forming solution 1 is obtained. Further, the resin coating layer-forming solution 1 and the Mn—Mg ferrite particles are put into a vacuum degassing type kneader, and toluene is removed by distillation. As a result, a carrier coated with a resin is formed. Next, fine powder and coarse powder are removed using an elbow jet. As a result, a carrier 1-1 is obtained.

Preparation of Carrier 1-2

A carrier 1-2 is obtained using the same preparation method as that of the carrier 1-1, except that Mn—Mg ferrite particle (volume average particle diameter: 33 μm) is used instead of Mn—Mg ferrite particle (volume average particle diameter: 43 μm).

Preparation of Carrier 1-3

A carrier 1-3 is obtained using the same preparation method as that of the carrier 1-1, except that Mn—Mg ferrite particle (volume average particle diameter: 58 μm) is used instead of Mn—Mg ferrite particle (volume average particle diameter: 43 μm).

Preparation of Carrier 1-4

A carrier 1-4 is obtained using the same preparation method as that of the carrier 1-1, except that Mn—Mg ferrite particle (volume average particle diameter: 23 μm) is used instead of Mn—Mg ferrite particle (volume average particle diameter: 43 μm).

Preparation of Carrier 2-1

Mn—Mg ferrite particles (volume average particle diameter: 28 μm): 100 parts

Cyclohexyl methacrylate/methyl methacrylate copolymer: 3 parts (copolymer molar ratio: 95:5)

Carbon black (VXC72, manufactured by Cabot Corporation): 0.3 parts

Toluene: 14 parts

Among the components constituting the carrier composition, the respective particles other than the Mn—Mg ferrite particles and glass beads (φ1 mm, the same amount as that of toluene) are stirred using a sand mill (manufactured by Kansai Paint Co., Ltd.) at 1200 ppm for 30 minutes. As a result, a resin coating layer-forming solution 1 is obtained. Further, the resin coating layer-forming solution 1 and the Mn—Mg ferrite particles are put into a vacuum degassing type kneader, and toluene is removed by distillation. As a result, a carrier coated with a resin is formed. Next, fine powder and coarse powder are removed using an elbow jet. As a result, a carrier 2-1 is obtained.

Preparation of Carrier 2-2

A carrier 2-2 is obtained using the same preparation method as that of the carrier 2-1, except that Mn—Mg ferrite particle (volume average particle diameter: 33 μm) is used instead of Mn—Mg ferrite particle (volume average particle diameter: 28 μm).

Preparation of Carrier 2-3

A carrier 2-3 is obtained using the same preparation method as that of the carrier 2-1, except that Mn—Mg ferrite particle (volume average particle diameter: 23 μm) is used instead of Mn—Mg ferrite particle (volume average particle diameter: 28 μm).

Preparation of Carrier 2-4

A carrier 2-4 is obtained using the same method as that of the carrier 2-1, except that the addition amount of the carbon black was changed from 0.3 parts to 0.9 parts.

The configurations of the prepared carriers, and the values of the volume resistivity and the volume average particle diameter thereof measured using the above-described above are shown in Table 1.

TABLE 1

| Carrier | Core Particles Volume Average Particle Diameter (μm) | Carbon Black Addition Amount (part(s)) | Carrier Volume Resistivity (Ωcm) | Carrier Volume Average Particle Diameter (μm) |
|---|---|---|---|---|
| 1-1 | 43 | 0 | $1.0 \times 10^9$ | 45 |
| 1-2 | 33 | 0 | $1.0 \times 10^9$ | 35 |
| 1-3 | 58 | 0 | $1.0 \times 10^9$ | 60 |
| 1-4 | 23 | 0 | $1.0 \times 10^9$ | 25 |
| 2-1 | 28 | 0.3 | $1.0 \times 10^8$ | 30 |
| 2-2 | 33 | 0.3 | $1.0 \times 10^8$ | 35 |
| 2-3 | 23 | 0.3 | $1.0 \times 10^8$ | 25 |
| 2-4 | 28 | 0.9 | $1.0 \times 10^6$ | 30 |

Preparation of Toner

Preparation of Toner 1B (Brilliant Toner)

Preparation of Polyester Resin

Dimethyl adipate: 74 parts

Dimethyl terephthalate: 192 parts

Ethylene oxide adduct of bisphenol A: 216 parts

Ethylene glycol: 38 parts

Tetrabutoxy titanate (catalyst): 0.037 parts

The above-described materials are put into a two-necked flask which is heated and dried. Nitrogen gas is introduced into the container, and then the materials are heated while being kept in an inert atmosphere and stirred. Next, a polycondensation reaction is caused to occur at 160° C. for 7 hours. Next, the container is heated to 220° C. while gradually reducing the pressure to 10 Torr, and is kept at 220° C. for 4 hours. Next, the pressure is returned to normal pressure, 9 parts of trimellitic anhydride is added, the pressure is gradually reduced to 10 Torr again, and the flask is kept at 220° C. for 1 hour. As a result, a polyester resin is obtained. The glass transition temperature (Tg) of the polyester resin is 64° C.

Preparation of Resin Particle Dispersion

Polyester resin: 160 parts

Ethyl acetate: 233 parts sodium hydroxide aqueous solution (0.3 N): 0.1 parts

The above-described materials are put into a 1 L separable flask, are heated at 70° C., and are stirred using a THREE-ONE motor (manufactured by Shinto Scientific Co., Ltd.) to prepare a resin mixed solution. 373 parts of ion exchange water is further added for phase-transfer emulsification while stirring the resin mixed solution at 90 rpm, and then the solvent is removed. As a result, a resin particle dispersion (solid content concentration: 30%) is obtained.

Preparation of Brilliant Pigment Dispersion

Flaky aluminum pigment (2173EA, manufactured by Toyo Aluminum K.K.): 100 parts

Anionic surfactant (NEOGEN R, manufactured by Daiichi Kogyo Seiyaku Co. Ltd.): 1.5 parts Ion exchange water: 900 parts The above-described materials are mixed and are dispersed using an emulsifying dispersing device (CAVITRON CR1010, manufactured by Pacific Machinery & Engineering Co., Ltd.) for 1 hour. As a result, a brilliant pigment dispersion (solid content concentration: 10%) is obtained.

Preparation of Release Agent Dispersion

Carnauba wax (RC-160, manufactured by Toakasei Co., Ltd.): 50 parts

Anionic surfactant (NEOGEN RK, manufactured by Daiichi Kogyo Seiyaku Co. Ltd.): 1.0 part Ion exchange water: 200 parts The above-described materials are mixed, are heated to 95° C., and are dispersed using a homogenizer (ULTRA TURRAX T50, manufactured by IKA). Next, the solution is further dispersed using a Manton-Gaulin high-pressure homogenizer (manufactured by Gaulin) for 360 minutes. As a result, a release agent dispersion (solid content concentration 20%) is obtained. The volume average particle diameter of release agent particles in the release agent dispersion is 230 nm.

Preparation of Brilliant Toner Particles

Resin particle dispersion: 500 parts (solid content concentration: 30%)

Brilliant pigment dispersion: 350 parts (solid content concentration: 10%)

Release agent dispersion: 50 parts (solid content concentration: 20%)

Nonionic surfactant (IGEPAL CA897): 1.40 parts

The above-described materials are put into a 2 L cylindrical stainless steel container (diameter: 30 cm) and are dispersed using a homogenizer (ULTRA TURRAX T50, manufactured by IKA) for 10 minutes while applying a shearing force at 4000 rpm. Next, 1.75 parts of a 10% polyaluminum chloride aqueous solution is slowly added dropwise, and the materials are dispersed using a homogenizer at a rotating speed of 5000 rpm for 15 minutes to prepare a raw material dispersion.

Next, the raw material dispersion is put into a polymerization tank including a stirrer with two paddles of stirring blades and a thermometer, starts to be heated using a mantle heater while being stirred at a stirring rotating speed of 1200 rpm, and is kept at 54° C. for 2 hours. As a result, a first aggregate is formed. At this time, the pH of the raw material dispersion is controlled to be from 2.2 to 3.5 using 0.3 N nitric acid and 1 N sodium hydroxide aqueous solution.

Next, 123 parts of the resin particle dispersion is added to deposit resin particles on a surface of the first aggregate. As a result, a second aggregate is formed. Next, the second aggregate is heated to 56° C. and kept at 56° C. for 2 hours while observing the form and size of the second aggregate using an optical microscope and a MULTISIZER II (manufactured by Beckman Coulter Inc.). Next, the pH is adjusted to increase to 8.0 and the temperature is increased to 67.5° C. such that the second aggregate coalesce. The pH was reduced to 6.0 while keeping the temperature at 67.5° C. After 1 hour, heating is stopped, and cooling is performed at a temperature decrease rate of 0.1° C./min. Next, the particles are sieved through a 20 μm mesh, are repeatedly washed with water, and are dried using a vacuum dryer. As a result, brilliant toner particles are obtained. The volume average particle diameter of the brilliant toner particles is 9 μm.

Preparation of Toner including External Additive 100 parts of the obtained brilliant toner particles and 1.5 parts of hydrophobic silica (RY50, manufactured by Nippon Aerosil Co., Ltd.) are mixed using a HENSCHEL mixer at a peripheral speed of 33 m/sec for 2 minutes. Next, the mixture is sieved through a vibration sieve having an opening of 45 μm, a toner 1B which is the brilliant toner including the external additive is obtained.

Preparation of Toner 2K (Black Toner)

Colorant Particle Dispersion K

Carbon black: 50 parts

Anionic surfactant: 5 parts

Ion exchange water: 200 parts

The above-described components are mixed, are dispersed with ULTRA TURRAX (manufactured by IKA) for 5 minutes, and are further dispersed in an ultrasonic bath for 10 minutes. As a result, a black colorant particle dispersion K having a solid content of 21% is obtained.

Release Agent Particle Dispersion 1

Paraffin wax (HNP-9 manufactured by Nippon Seiro Co. Ltd.): 19 parts

Anionic surfactant (NEOGEN SC, manufactured by Daiichi Kogyo Seiyaku Co. Ltd.): 1 part Ion exchange water: 80 parts The above-described components are mixed in a heat-resistant container, are heated to 90° C. for 30 minutes, and are stirred. Next, the molten solution is caused to flow from the bottom of the container to a Gaulin homogenizer, and a circulation operation corresponding to three passes is performed under a pressure condition of 5 MPa. Next, a circulation operation corresponding to three passes is further performed under an increased pressure of 35 MPa. An emulsion obtained as above is cooled to 40° C. or lower in the heat-resistant container. As a result, a release agent particle dispersion 1 is obtained.

Resin Particle Dispersion 1

Oil Phase

Styrene (manufactured by Wako Pure Chemical Industries Ltd.): 30 parts

N-butyl acrylate (manufactured by Wako Pure Chemical Industries Ltd.): 10 parts

β-carboxyethyl acrylate (manufactured by Solvay): 1.3 parts

Dodecanethiol (manufactured by Wako Pure Chemical Industries Ltd.): 0.4 parts

Water Phase 1

Ion exchange water: 17 parts

Anionic surfactant (DAWFAX manufactured by The Dow Chemical Company): 0.4 parts

Water Phase 2

Ion exchange water: 40 parts

Anionic surfactant (DAWFAX manufactured by The Dow Chemical Company): 0.05 parts Ammonium peroxodisulfate (manufactured by Wako Pure Chemical Industries Ltd.): 0.4 parts The above-described components of the oil phase and the above-described components of the water phase 1 are put into a flask and are stirred and mixed. As a result, a monomer emulsion dispersion is obtained.

The above-described components of the water phase 2 are put into a reaction container, the atmosphere in the container is sufficiently substituted with nitrogen, and the reaction container is heated in an oil bath under stirring until the internal temperature of the reaction system reaches 75° C.

Further, the monomer emulsion dispersion is slowly added dropwise to the inside of the reaction container for 3 hours, and emulsion polymerization is performed. After the completion of the dropwise addition, the polymerization is continued at 75° C. After 3 hours, the polymerization is finished.

The volume average particle diameter D50v of the obtained resin particles is 250 nm which is measured using a laser diffraction particle diameter distribution analyzer (LA-700, manufactured by Horiba Ltd.).

The glass transition temperature of the resin is 52° C. which is measured using a differential scanning calorimeter (DSC-50, manufactured by Shimadzu Corporation) at a temperature increase rate of 10° C./min.

The number average molecular weight (in terms of polystyrene) is 13,000 which is measured using a molecular weight measuring device (HLC-8020, manufactured by Tosoh Corporation) and THF (tetrahydrofuran) as a solvent.

As a result, a resin particle dispersion 1 having a volume average particle diameter of 250 nm, a solid content of 42%, a glass transition temperature of 52° C., and a number average molecular weight Mn of 13,000 is obtained.

Preparation of Toner Particles K

Resin Particle Dispersion 1: 150 Parts

Colorant particle dispersion K: 30 parts

Release Agent Particle Dispersion 1: 40 Parts

Polyaluminum chloride: 0.4 parts

The above-described components are sufficiently mixed and stirred in a stainless steel flask using ULTRA TURRAX (manufactured by IKA). Next, the flask is heated to 48° C. in a heating oil bath under stirring. After the flask is kept at 48° C. for 80 minutes, 70 parts of the resin particle dispersion 1 is added thereto.

Next, the pH in the system is adjusted to 6.0 using a sodium hydroxide aqueous solution having a concentration 0.5 mol/L, the stainless steel flask is sealed, and a stirring shaft is sealed with a magnetic force. The flask is heated to 97° C. under stirring and is kept at 97° C. for 3 hours. After the completion of the reaction, the flask is cooled at a temperature decrease rate of 1° C./min, is filtered, is washed with ion exchange water, and undergoes solid-liquid separation by Nutsche suction filtration. The solid is redispersed in 3 L of ion exchange water at 40° C., is stirred, and is washed at 300 rpm for 15 minutes.

This washing operation is repeated 5 times. In a case where the pH of the filtrate is 6.54, and the electrical conductance is 6.5 μS/cm, solid-liquid separation is performed by Nutsche suction filtration with No. 5A filter paper. Next, the solid is dried in a vacuum for 12 hours. As a result, toner particles K are obtained.

The volume average particle diameter of toner particles K is 6.2 μm which is measured using COULTER MULTISIZER II (manufactured by Beckman Coulter Co., Ltd.) and an aperture having an aperture size of 50 μm, and the volume average particle diameter distribution index GSDv thereof is 1.20.

The shape factor SF1 of the particles is 135 in a case where the shape thereof is observed using an image analyzer LUZEX (manufactured by Nireco Corporation).

In addition, the glass transition temperature of the toner particles K is 52° C.

External Addition of External Additive

Further, silica ($SiO_2$) particles having an average primary particle diameter of 40 nm, which are surface-treated with a hydrophobizing agent of hexamethyldisilazane (HMDS), and metatitanic acid compound particles having an average primary particle diameter of 20 nm, which are a reaction product of metatitanic acid and isobutyl trimethoxy silane, are added to the toner particles K such that a coverage ratio of the surfaces of the toner particles K is 40%. The mixture is mixed using a Henschel mixer. As a result, a toner 2K as a black toner is prepared.

Preparation of Toner 2Y (Yellow Toner), Toner 2M (Magenta Toner), and Toner 2C (Cyan Toner)

Colorant Particle Dispersions Y, M, and C

A yellow colorant particle dispersion Y, a magenta colorant particle dispersion M, and a cyan colorant particle dispersion C are obtained using the same preparation method as that of the colorant particle dispersion K, except that a yellow pigment (PY180; manufactured by Clariant Japan K.K.), a magenta pigment (PR122; manufactured by DIC Corporation), and a cyan pigment (copper phthalocyanine, C.I. Pigment Blue 15:3; manufactured by Dainichiseika Colr&Chemicals Mfg. Co., Ltd.) are used instead of carbon black, respectively.

Preparation of Toner Particles Y, M, and C

Yellow toner particles Y, magenta toner particles M, and cyan toner particles C are prepared using the same preparation method as that of the toner particles K, except that the yellow colorant particle dispersion Y, the magenta colorant particle dispersion M, and the cyan colorant particle dispersion C are used instead of the black colorant particle dispersion K, respectively.

External Addition of External Additive

A toner 2Y as a yellow toner, a toner 2M as a magenta toner, and a toner 2C as a cyan toner were obtained using the same method as that of the toner 2K as a black toner, except that the toner particles Y, the toner particles M, and the toner particles C are used instead of the toner particles K.

Preparation of Toner 1W (White Toner)

Colorant Particle Dispersion W

Titanium oxide particles (1) (trade name: CR-60-2, manufactured by Ishihara Sangyo Kaisha Ltd.): 210 parts Nonionic surfactant (trade name: NONIPOL 400, manufactured by Sanyo Chemical Industries, Ltd.): 10 parts Ion exchange water: 480 parts The above-described materials are mixed with each other, are stirred using a homogenizer (ULTRA TURRAX T50, manufactured by IKA) for 30 minutes, and are dispersed using a high pressure impact dispersing machine (ALTIMIZER HJP30006, manufactured by Sugino Machine Ltd.) for 1 hour. Further, after keeping the dispersion to remove the supernatant, a colorant particle dispersion W (solid content concentration: 30%) in which titanium oxide particles having a number average particle diameter of 300 nm are dispersed is prepared.

Preparation of Toner Particles W

White toner particles W are prepared using the same preparation method as that of the toner particles K, except that the white colorant particle dispersion W is used instead of the black colorant particle dispersion K.

External Addition of External Additive

A toner 1W as a white toner is obtained using the same method as that of the toner 2K as the black toner, except that the toner particles W are used instead of the toner particles K.

Preparation of Toner 1T (Transparent Toner)

Preparation of Toner Particles T

Transparent toner particles T are prepared using the same preparation method as that of the toner particles K, except that the black colorant particle dispersion K is not used.

External Addition of External Additive

A toner 1T as a transparent toner is obtained using the same method as that of the toner 2K as the black toner, except that the toner particles T are used instead of the toner particles K.

The configurations of the prepared toners, and values of the dielectric loss tangent measured using the above-described methods are shown in Table 2.

TABLE 2

| | Colorant | | Toner |
|---|---|---|---|
| Toner | Kind | Content in Toner Particles (% by mass) | Dielectric Loss Tangent |
| 1B | Brilliant Pigment | 20 | $60 \times 10^{-3}$ |
| 2K | Carbon Black | 8 | $25 \times 10^{-3}$ |
| 2Y | Yellow Pigment | 8 | $21 \times 10^{-3}$ |
| 2M | Magenta Pigment | 8 | $20 \times 10^{-3}$ |
| 2C | Cyan Pigment | 8 | $17 \times 10^{-3}$ |
| 1W | White Pigment | 40 | $50 \times 10^{-3}$ |
| 1T | None | 0 | $20 \times 10^{-3}$ |

Preparation of Developer 100 parts of the carrier shown in Table 3 and 10 parts of the toner shown in Table 3 are stirred using a V-blender at 40 rpm for 20 minutes and are sieved through a sieve having a pore size of 125 μm. This way, respective developers are obtained.

TABLE 3

| Kind | Developer No. | Carrier No. | Toner No. |
|---|---|---|---|
| Brilliant Developer | 1B-1 | 1-1 | 1B |
| | 1B-2 | 1-2 | 1B |
| | 1B-3 | 1-3 | 1B |
| | 1B-4 | 1-4 | 1B |
| Black Developer | 2K-1 | 2-1 | 2K |
| | 2K-2 | 2-2 | 2K |
| | 2K-3 | 2-3 | 2K |
| | 2K-4 | 2-4 | 2K |
| Yellow Developer | 2Y-1 | 2-1 | 2Y |
| | 2Y-2 | 2-2 | 2Y |
| | 2Y-3 | 2-3 | 2Y |
| | 2Y-4 | 2-4 | 2Y |
| Magenta Developer | 2M-1 | 2-1 | 2M |
| | 2M-2 | 2-2 | 2M |
| | 2M-3 | 2-3 | 2M |
| | 2M-4 | 2-4 | 2M |
| Cyan Developer | 2C-1 | 2-1 | 2C |
| | 2C-2 | 2-2 | 2C |
| | 2C-3 | 2-3 | 2C |
| | 2C-4 | 2-4 | 2C |
| White Developer | 1W-1 | 1-1 | 1W |
| | 1W-2 | 1-2 | 1W |
| | 1W-3 | 1-3 | 1W |
| | 1W-4 | 1-4 | 1W |
| Transparent Developer | 1T-1 | 1-1 | 1T |
| | 1T-2 | 1-2 | 1T |
| | 1T-3 | 1-3 | 1T |
| | 1T-4 | 1-4 | 1T |

Examples B1 to B6, Comparative Examples B1 and B2, Examples W1 to W6, Comparative Examples W1 and W2, Examples T1 to T6, and Comparative Examples T1 and T2

In the image forming apparatus (Model No.: a modified machine of DocuCentre Color 400, manufactured by Fuji Xerox Co., Ltd.) shown in FIG. 1, the developing devices 120B, 120Y, 120M, 120C, and 120K of the units 150B, 150Y, 150M, 150C, and 150K are filled with the developers shown in Table 4, respectively, and images are formed under the following conditions.

Specifically, images are printed on A4-size plain paper (C2 paper, manufactured by Fuji Xerox Co., Ltd.) in the following procedure in a low-temperature and low-humidity environment (temperature: 10° C., humidity: 10% RH).

First, on Day 1, 10000 images having a rectangular patch (5.2 cm×1.2 cm) with an image density of 1% of each of colors (that is, five colors shown in the table) are continuously printed. Next, in an initial operation of Day 2, two images of The Imaging Society of Japan Test Chart No. 5 are printed, and then 10000 images having a rectangular patch (5.2 cm×1.2 cm) with an image density 1% of each of the colors are continuously printed. The image printing procedure of Day 2 is repeated every day. The number of images having a rectangular patch with an image density 1% which have been printed until Day 10 is 100,000. In an initial operation of the next day, two images of The Imaging Society of Japan Test Chart No. 5 are printed, and the evaluations (evaluation on formation of a white line and density unevenness) of the images are performed. The results are shown in the following tables. In addition, the volume resistivity ratio of the carriers (the volume resistivity of the first carrier/the volume resistivity of the second carrier) and the volume average particle diameter ratio of the carriers (the volume average particle diameter of the first carrier/the volume average particle diameter of the second carrier) are collectively shown in the following tables.

Evaluation of Formation of White Line

Whether or not formation of a white line and a decrease in density caused by removal of the toner occur on the obtained images (The Imaging Society of Japan Test Chart No. 5) is determined by visual inspection. Evaluation criteria are described below.

A: the formation of a white line is not observed on the image

B: a decrease in density slightly caused by removal of the toner is observed, but there are no problems in image quality C: the formation of a white line is slightly observed on the image D: the formation of a white line is clearly observed on the image Evaluation of Density Unevenness A density variation ΔE on the obtained images (The Imaging Society of Japan Test Chart No. 5) was evaluated by obtaining a difference between a three-point average in the first solid image patch and a three-point average in the second solid image patch.

Specifically, the density variation ΔE is obtained from the expression "$\Delta E=|E1-E2|$", in which E1 represents an average value of chromacity E ("the three-point average in the first solid image patch" described above) that is measured using an imaging spectrocolorimeter (RM200QC, manufactured by X-Rite Inc.) regarding the yellow solid image on the first image among the obtained two images, and E2 represents an average value of chromacity E ("the three-point average in the second solid image patch" described above) that is measured using an imaging spectrocolorimeter (RM200QC, manufactured by X-Rite Inc.) regarding the yellow solid image on the second image among the obtained two images.

The chromacity E is a value calculated from the expression "$E=\{(L^*)^2+(a^*)^2+(b^*)^2\}^{0.5}$", and L*, a*, and b* are coordinate values in the L*a*b* color space.

Evaluation criteria are described below.

A: the density variation ΔE in the images is lower than 0.3, density unevenness is observed by visual inspection, and there are no problems in image quality B: the density variation ΔE in the images is 0.3 or higher and lower than 0.5, density unevenness is very slightly observed by visual inspection, and there are no problems in image quality C: the density variation ΔE in the images is 0.5 or higher and lower than 1.0, and density unevenness is slightly observed by visual inspection D: the density variation ΔE in the images is higher than 1.0, and density unevenness is clearly observed by visual inspection

TABLE 4

| | Developer No. | | | | | Carrier | | Evaluation | |
|---|---|---|---|---|---|---|---|---|---|
| | Developing Device 120B | Developing Device 120Y | Developing Device 120M | Developing Device 120C | Developing Device 120K | Volume Resistivity Ratio | Volume Average Particle Diameter Ratio | Formation of White Line | Density Unevenness |
| Example B1 | 1B-1 | 2Y-1 | 2M-1 | 2C-1 | 2K-1 | 10 | 1.50 | A | B |
| Example B2 | 1B-2 | 2Y-1 | 2M-1 | 2C-1 | 2K-1 | 10 | 1.17 | B | B |
| Example B3 | 1B-1 | 2Y-2 | 2M-2 | 2C-2 | 2K-2 | 10 | 1.29 | B | B |
| Example B4 | 1B-1 | 2Y-3 | 2M-3 | 2C-3 | 2K-3 | 10 | 1.80 | A | A |
| Example B5 | 1B-3 | 2Y-1 | 2M-1 | 2C-1 | 2K-1 | 10 | 2.00 | A | B |
| Example B6 | 1B-1 | 2Y-4 | 2M-4 | 2C-4 | 2K-4 | 1000 | 1.50 | A | A |
| Comparative Example B1 | 1B-2 | 2Y-2 | 2M-2 | 2C-2 | 2K-2 | 10 | 1.00 | D | C |
| Comparative Example B2 | 1B-4 | 2Y-1 | 2M-1 | 2C-1 | 2K-1 | 10 | 0.83 | D | C |

TABLE 5

| | Developer No. | | | | | Carrier | | Evaluation | |
|---|---|---|---|---|---|---|---|---|---|
| | Developing Device 120B | Developing Device 120Y | Developing Device 120M | Developing Device 120C | Developing Device 120K | Volume Resistivity Ratio | Volume Average Particle Diameter Ratio | Formation of White Line | Density Unevenness |
| Example W1 | 1W-1 | 2Y-1 | 2M-1 | 2C-1 | 2K-1 | 10 | 1.50 | A | B |
| Example W2 | 1W-2 | 2Y-1 | 2M-1 | 2C-1 | 2K-1 | 10 | 1.17 | B | B |
| Example W3 | 1W-1 | 2Y-2 | 2M-2 | 2C-2 | 2K-2 | 10 | 1.29 | B | B |
| Example W4 | 1W-1 | 2Y-3 | 2M-3 | 2C-3 | 2K-3 | 10 | 1.80 | A | B |
| Example W5 | 1W-3 | 2Y-1 | 2M-1 | 2C-1 | 2K-1 | 10 | 2.00 | B | B |
| Example W6 | 1W-1 | 2Y-4 | 2M-4 | 2C-4 | 2K-4 | 1000 | 1.50 | A | A |
| Comparative Example W1 | 1W-2 | 2Y-2 | 2M-2 | 2C-2 | 2K-2 | 10 | 1.00 | D | C |
| Comparative Example W2 | 1W-4 | 2Y-1 | 2M-1 | 2C-1 | 2K-1 | 10 | 0.83 | D | C |

TABLE 6

| | Developer No. | | | | | Carrier | | Evaluation | |
|---|---|---|---|---|---|---|---|---|---|
| | Developing Device 120B | Developing Device 120Y | Developing Device 120M | Developing Device 120C | Developing Device 120K | Volume Resistivity Ratio | Volume Average Particle Diameter Ratio | Formation of White Line | Density Unevenness |
| Example T1 | 1T-1 | 2Y-1 | 2M-1 | 2C-1 | 2K-1 | 10 | 1.50 | A | B |
| Example T2 | 1T-2 | 2Y-1 | 2M-1 | 2C-1 | 2K-1 | 10 | 1.17 | B | B |
| Example T3 | 1T-1 | 2Y-2 | 2M-2 | 2C-2 | 2K-2 | 10 | 1.29 | B | B |
| Example T4 | 1T-1 | 2Y-3 | 2M-3 | 2C-3 | 2K-3 | 10 | 1.80 | A | B |
| Example T5 | 1T-3 | 2Y-1 | 2M-1 | 2C-1 | 2K-1 | 10 | 2.00 | B | B |
| Example T6 | 1T-1 | 2Y-4 | 2M-4 | 2C-4 | 2K-4 | 1000 | 1.50 | A | A |
| Comparative Example T1 | 1T-2 | 2Y-2 | 2M-2 | 2C-2 | 2K-2 | 10 | 1.00 | D | D |
| Comparative Example W2 | 1T-4 | 2Y-1 | 2M-1 | 2C-1 | 2K-1 | 10 | 0.83 | D | D |

It is found from the results that, in Examples, formation of a white line which may occur on an image formed after continuous formation of low-density images is suppressed as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that includes a first image holding member and a first developing unit, the first developing unit accommodating a first developer that includes a first toner and a first carrier and developing an electrostatic charge image formed on a surface of the first image holding member using the first developer to form a first toner image on the surface of the first image holding member;

a first transfer unit that transfers the first toner image formed on the surface of the first image holding member to a transfer medium;

a second image forming unit that is disposed downstream of the first image forming unit in a traveling direction of the transfer medium and includes a second image holding member and a second developing unit, the second developing unit accommodating a second developer that includes a second toner and a second carrier and developing an electrostatic charge image formed on a surface of the second image holding member using the second developer to form a second toner image on the surface of the second image holding member; and a second transfer unit that transfers the second toner image formed on the surface of the second image holding member to the transfer medium to which the first toner image is transferred, wherein a volume resistivity of the first carrier is higher than a volume resistivity of the second carrier, and a volume average particle diameter of the first carrier is more than a volume average particle diameter of the second carrier.

2. The image forming apparatus according to claim 1, wherein the volume resistivity of the first carrier is from 3.2 times to 50000 times with respect to the volume resistivity of the second carrier.

3. The image forming apparatus according to claim 2, wherein the volume resistivity of the second carrier is from $10^6$ Ωcm to $10^{14}$ Ωcm.

4. The image forming apparatus according to claim 1, wherein the volume average particle diameter of the first carrier is from 1.1 times to 2.0 times with respect to the volume average particle diameter of the second carrier.

5. The image forming apparatus according to claim 4, wherein the volume average particle diameter of the first carrier is from 1.4 times to 1.8 times with respect to the volume average particle diameter of the second carrier.

6. The image forming apparatus according to claim 4, wherein the volume average particle diameter of the second carrier is from 25 μm to 40 μm.

7. The image forming apparatus according to claim 1, wherein a dielectric loss tangent of the first toner is higher than a dielectric loss tangent of the second toner.

8. The image forming apparatus according to claim 7, wherein the dielectric loss tangent of the first toner is from 1.5 times to 5.0 times with respect to the dielectric loss tangent of the second toner.

9. The image forming apparatus according to claim 7, wherein the dielectric loss tangent of the first toner is from $30\times10^{-3}$ to $70\times10^{-3}$.

10. The image forming apparatus according to claim 7, wherein the first toner includes at least one of a flaky brilliant pigment or a white pigment.

11. The image forming apparatus according to claim 1, wherein the first toner is a transparent toner.

12. The image forming apparatus according to claim 1, wherein three or more image forming units including the first image forming unit and the second image forming unit are disposed along the traveling direction of the transfer medium, and the first image forming unit is disposed on a most upstream side in the traveling direction of the transfer medium among the three or more image forming units.

13. The image forming apparatus according to claim 12, wherein an image forming unit that is disposed on a second most upstream side in the traveling direction of the transfer medium among the three or more image forming units is the second image forming unit.

14. The image forming apparatus according to claim 13, wherein, among the three or more image forming units, image forming units other than the first image forming unit are the second image forming units.

15. The image forming apparatus according to claim 12, wherein three to five image forming units including the first image forming unit and the second image forming unit are disposed along the traveling direction of the transfer medium.

* * * * *